US010257609B2

(12) United States Patent
Bolognia et al.

(10) Patent No.: US 10,257,609 B2
(45) Date of Patent: Apr. 9, 2019

(54) METHOD OF FORMING A PACKAGED MICROPHONE

(71) Applicant: Invensense, Inc., San Jose, CA (US)

(72) Inventors: David Bolognia, North Andover, MA (US); Kieran Harney, Andover, MA (US)

(73) Assignee: INVENSENSE, INC., San Jose, CA (US)

( * ) Notice: Subject to any disclaimer, the term of this patent is extended or adjusted under 35 U.S.C. 154(b) by 127 days.

(21) Appl. No.: 15/133,169

(22) Filed: Apr. 19, 2016

(65) Prior Publication Data

US 2016/0234592 A1 Aug. 11, 2016

Related U.S. Application Data

(62) Division of application No. 14/593,397, filed on Jan. 9, 2015, now Pat. No. 9,332,332, which is a division of application No. 13/769,013, filed on Feb. 15, 2013, now Pat. No. 8,965,027.

(51) Int. Cl.

| | |
|---|---|
| ***H04R 31/00*** | (2006.01) |
| ***H04R 1/28*** | (2006.01) |
| ***H04R 1/04*** | (2006.01) |
| ***H04R 1/08*** | (2006.01) |
| ***H04R 1/22*** | (2006.01) |
| ***H04R 19/00*** | (2006.01) |
| ***H04R 19/04*** | (2006.01) |

(52) U.S. Cl.

CPC ..... *H04R 1/2892* (2013.01); *H04R 1/04* (2013.01); *H04R 1/08* (2013.01); *H04R 1/222* (2013.01); *H04R 19/005* (2013.01); *H04R 19/04* (2013.01); *H04R 31/006* (2013.01); *H04R 2201/003* (2013.01); *H04R 2201/029* (2013.01); *H04R 2410/03* (2013.01)

(58) Field of Classification Search

CPC . H04R 1/04; H04R 1/08; H04R 1/222; H04R 1/2892; H04R 17/02; H04R 19/005; H04R 19/04; H04R 21/02; H04R 31/006

See application file for complete search history.

(56) References Cited

U.S. PATENT DOCUMENTS 3,989,895 A * 11/1976 O'Daniel, Sr. ..... A61B 7/026 381/67
6,920,225 B2 * 7/2005 Yonehara ..... H04R 19/016 381/174
6,928,178 B2 * 8/2005 Chang ..... H04R 19/016 29/594

(Continued)

*Primary Examiner* — Paul D Kim

(74) *Attorney, Agent, or Firm* — Maryam Imam; Hickman Palermo; Becker Bingham LLP

(57) ABSTRACT

A packaged microphone has a lid structure with an inner surface having a concavity, and a microphone die secured within the concavity. The packaged microphone also has a substrate coupled with the lid structure to form a package having an interior volume containing the microphone die. The substrate is electrically connected with the microphone die. In addition, the packaged microphone also has aperture formed through the package, and a seal proximate to the microphone die. The seal acoustically seals the microphone and the aperture to form a front volume and a back volume within the interior volume. The aperture is in acoustic communication with the front volume.

18 Claims, 23 Drawing Sheets

(56) References Cited

U.S. PATENT DOCUMENTS

| | | | | |
|---|---|---|---|---|
| 7,835,532 | B2 * | 11/2010 | Yonehara | H04R 19/04 29/594 |
| 7,835,533 | B2 * | 11/2010 | Yonehara | H04R 19/016 29/594 |
| 8,050,443 | B2 * | 11/2011 | Izuchi | H04R 19/016 381/174 |
| 8,218,794 | B2 * | 7/2012 | Pahl | H04R 1/04 381/175 |
| 8,472,648 | B2 | 6/2013 | Wang et al. | |
| 8,553,921 | B2 * | 10/2013 | Yao | H04R 19/04 381/174 |
| 8,571,249 | B2 * | 10/2013 | Wang | H04R 19/005 257/704 |
| 8,577,063 | B2 | 11/2013 | Yang | |
| 8,629,551 | B1 | 1/2014 | Minervini | |
| 9,716,524 | B2 * | 7/2017 | Rostami | H04B 1/3888 |

* cited by examiner

METHOD OF FORMING A PACKAGED MICROPHONE

This application is a divisional application of U.S. application Ser. No. 14/593,397, filed on Jan. 9, 2015, now U.S. Pat. No. 9,332,332, by David Bolognia, which is a divisional application of U.S. application Ser. No. 13/769,013, filed Feb. 15, 2013, now U.S. Pat. No. 8,965,027, by David Bolognia, the full disclosure of which is hereby incorporated by reference herein.

FIELD OF THE INVENTION

The invention generally relates to acoustic devices and, more particularly, the invention relates to MEMS acoustic devices and packaging of MEMS acoustic devices.

BACKGROUND OF THE INVENTION

MEMS microphones typically are secured within an interior chamber of a package to protect them from the environment. An integrated circuit chip, also mounted within the interior chamber and having active circuit elements, processes electrical signals to and from the microphone. One or more apertures through some portion of the package permit acoustic signals to reach the microphone. Receipt of the audio signal causes the microphone, with its corresponding integrated circuit chip, to produce an electronic signal representing the audio qualities of the received signal.

Interconnection of the microphone with other components can be challenging. Flip chip interconnections, for example, often require expensive specialized equipment that ultimately increases fabrication costs.

SUMMARY OF THE INVENTION

In accordance with one embodiment of the invention, a packaged microphone has a lid structure with an inner surface having a concavity, and a microphone die secured within the concavity. The packaged microphone also has a substrate coupled with the lid structure to form a package having an interior volume containing the microphone die. The substrate is electrically connected with the microphone die. In addition, the packaged microphone also has aperture formed through the package, and a seal proximate to the microphone die. The seal acoustically seals the microphone and the aperture to form a front volume and a back volume within the interior volume. The aperture is in acoustic communication with the front volume.

The lid structure may be formed from a cover and a frame that are secured together to form the back volume. Among other things, the lid structure may be formed at least in part from injection molded plastic. For example, the lid structure may include a printed circuit board secured to a molded frame.

The microphone die may include a variable capacitor formed from a diaphragm and a backplate. In that case, the microphone die may be mounted with the diaphragm a first distance from the aperture and the backplate a second, longer distance from the aperture. Moreover, the seal may be positioned between the microphone and the substrate, or between the substrate and the lid structure.

To make an effective electrical connection, the packaged microphone may have a bump or ball electrically connecting the microphone die to the substrate. In addition, or alternatively, the substrate may have an external surface mountable pad that is electrically connected with the microphone die.

In accordance with another embodiment, a packaged microphone has a molded cover and a molded frame secured to the cover. The frame and cover together form a lid structure. The frame has a frame surface with a concavity having a microphone die secured within it. The packaged microphone also has a substrate coupled with the lid structure and electrically connected with the microphone die. The substrate and lid structure together form a package having an interior volume containing the microphone die within the concavity. At least one of a bump and ball electrically connects the substrate with the microphone die. The packaged microphone further has an aperture through the package, and a seal proximate to the microphone die. The seal acoustically seals the microphone and the aperture to form a front volume and a back volume within the interior volume.

In accordance with other embodiments of the invention, a method of forming a packaged microphone secures an array of covers to an array of molded frames to form an array of assemblies. Each frame has a surface forming a concavity. The method mounts a plurality of microphone dies within a plurality of the concavities in the array of molded frames. To that end, each of the plurality of concavities has no more than one microphone die. In addition, the method secures an array of substrates to the array of assemblies to form an array of packages that each have interior volumes. Each package has a seal that forms a back volume and a front volume within the interior volume. Finally, the method cuts the array of packages to form individual packages.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, the package of a packaged microphone (also referred to as a "microphone system") has a lid structure that significantly improves fabrication efficiencies, while facilitating electrical interconnection of internal components, such as MEMS microphones and other integrated circuits. To that end, the lid structure has a concavity for mounting a microphone die in a manner that permits relatively easy electrical interconnection with an underlying package base. In addition, existing fabrication processes can process the lid structure in panel form, permitting low cost batch processing. Details of a number of illustrative embodiments are discussed below.

Figure 1A:
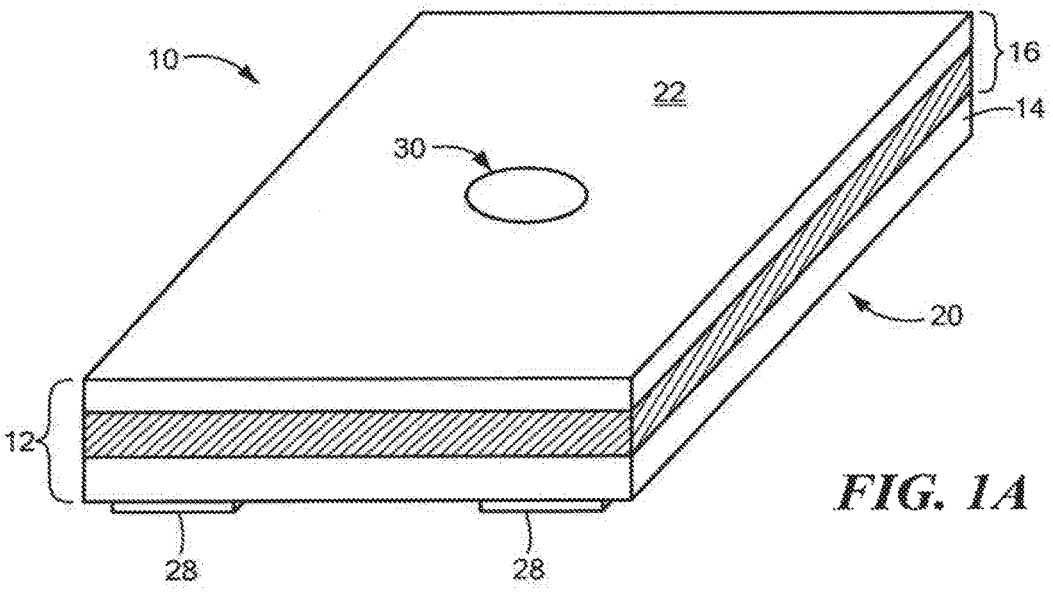
FIG. 1A schematically shows a perspective view of a top-port packaged microphone that may be configured in accordance with illustrative embodiments of the invention.
Figure 1B:
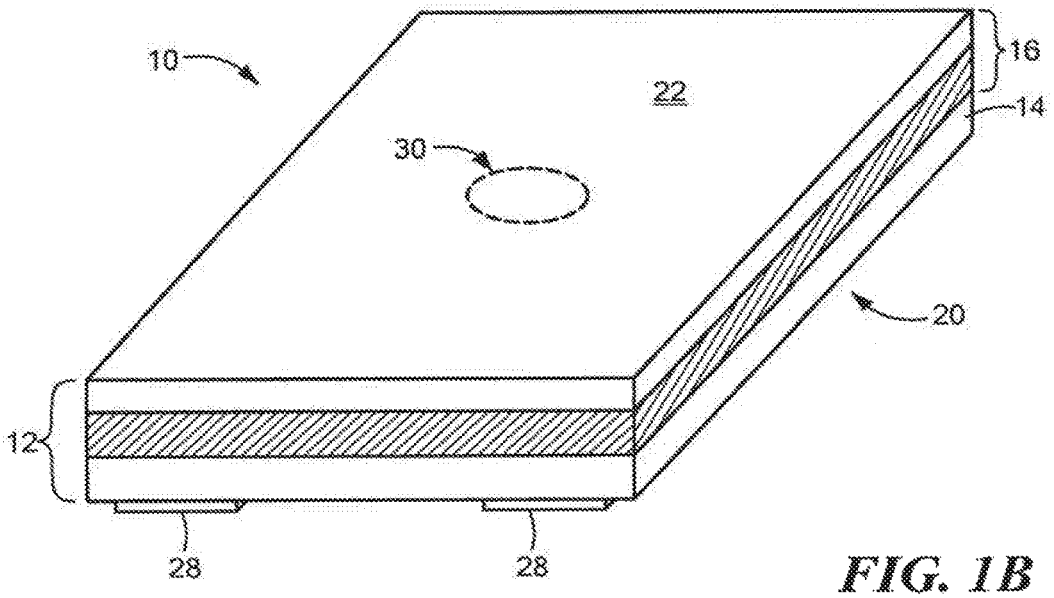
FIG. 1B schematically shows a perspective view of a bottom-port packaged microphone that may be configured in accordance with illustrative embodiments of the invention.

FIGS. 1A and 1B schematically show a packaged microphone system 10 (as noted above, also referred to as a "microphone system 10" or "packaged microphone 10") implemented in accordance with illustrative embodiments of the invention. The packaged microphone 10 has a package 12 that may be coupled with an underlying apparatus, such as a printed circuit board within a hearing instrument, computer, mobile telephone, or other device that typically has acoustic transducing capabilities. The printed circuit board, however, can have any of a variety of other devices (e.g., other integrated circuits). Moreover, the package 12 can be mounted to another type of underling device (e.g., the housing wall of a mobile telephone, or another packaged device). Accordingly, discussion of a printed circuit board is illustrative and not intended to limit a variety of other embodiments.

The package 12 has a base 14 that, together with a corresponding lid structure 16, forms an interior chamber 18 containing at least two dies that together receive and process incoming acoustic signals. To form the interior chamber 18, the lid structure 16 has two primary sections (discussed in greater detail below) that are integrated together form the single entire lid structure 16. Accordingly, from the exterior, these two sections form a rectangular structure having four side walls 20 (one on each side) extending downwardly from a substantially planar, rectangular top outer surface 22. In a corresponding manner, the base 14 has generally planar, rectangular top and bottom surfaces. Some embodiments, however, can have a base 14 with upwardly extending walls (not shown). The lid structure 16 couples to the top surface of the base 14 to form the interior chamber 18 as shown.

The interior chamber 18 contains at least one microelectromechanical system microphone die 24 (not shown in this figure, but discussed in detail below with regard to FIGS. 2A and 2B, also known as a "MEMS microphone" or "silicon microphone") for receiving and converting incoming acoustic signals into electronic signals, and a circuit die 26 (e.g., an ASIC, also not shown in this figure, but discussed with regard to FIG. 3A and subsequent figures) for controlling and processing signals within the system 10. After it is converted into an electrical signal, the acoustic signal is routed out of the package 12 by one or more electrical interconnects through the package 12.

In particular, the bottom face/surface of the package base 14 has a number of external contacts/bond pads or pins 28 for electrically (and physically, in many anticipated uses) connecting the microphone system 10 with an external apparatus. This connection may be a surface mounted connection, or some other conventional connection. As noted above, the external apparatus may include a printed circuit board or other electrical interconnect apparatus of the next level device (e.g., of a hearing instrument or mobile device). Accordingly, during use, the microphone die 24, and circuit die 26 cooperate to convert acoustic and/or audio signals received within its interior chamber 18 into electrical signals, and route those signals through external contacts/bond pads 28 in the base 14 to a circuit board or other external device.

The base 14 and lid structure 16 may be formed at any of a variety of different types of materials known in the art for this purpose. For example, the base 14 and/or the lid structure 16 both may be produced primarily from injection molded plastic. To protect the microphone die 24 from electromagnetic interference ("EMI"), one or both of the base 14 and lid structure 16 also may have conductive components. For example, each of the base 14 and lid structure 16 may have a layer of metal on their interior surfaces, or metal integrated into the interior of their bodies. For example, the base 14 and/or lid structure 16 may be plated with a layer of copper nickel (CuNi). Alternatively, the plastic material may have embedded conductive particles, such as silver particles. Other embodiments may form the base 14 from an electrical interconnect device, such as printed circuit board material. For example, the electrical interconnect device may include one or more of FR-4, ceramic, a carrier substrate, a premolded leadframe, or other known structures commonly used for those purposes. Like the base 14, the lid structure 16 also may be formed from other materials, such as metal or circuit board material. Moreover, as discussed in greater detail below, the lid structure 16 also may incorporate an electrical interconnect apparatus, such as those noted above.

To reach the interior, acoustic signals pass through some opening in the package 12. To that end, both packaged microphones 10 of FIGS. 1A and 1B have at least one or more acoustic signal inlet apertures 30 for receiving incoming acoustic signal. These apertures 30 permit an acoustic signal to directly contact the microphone die 24 within the interior chamber 18. The primary difference between the packaged microphones 10 of FIGS. 1A and 1B is the location of their respective apertures 30.

Specifically, the packaged microphone 10 of FIG. 1A has its aperture 30 through its lid structure 16, while the packaged microphone 10 of FIG. 1B has its aperture 30 (shown in phantom as it is not visible from the angle of FIG. 1B) through its base 14. As such, the packaged microphone 10 of FIG. 1A may be referred to as a "top port microphone," while the packaged microphone 10 of FIG. 1B may be referred to as a "bottom port microphone." As is common in the art, the designation of the type of packaged microphone 10 often is with reference to the position of its aperture 30 position relative to the device to which it is mounted. For example, if mounted to a printed circuit board, a top port microphone typically may have its aperture 30 on the package surface that is opposite to the underlying printed circuit board. In contrast, a bottom port microphone typically may have its aperture 30 mounted directly to the printed circuit board surface.

Figure 2A:
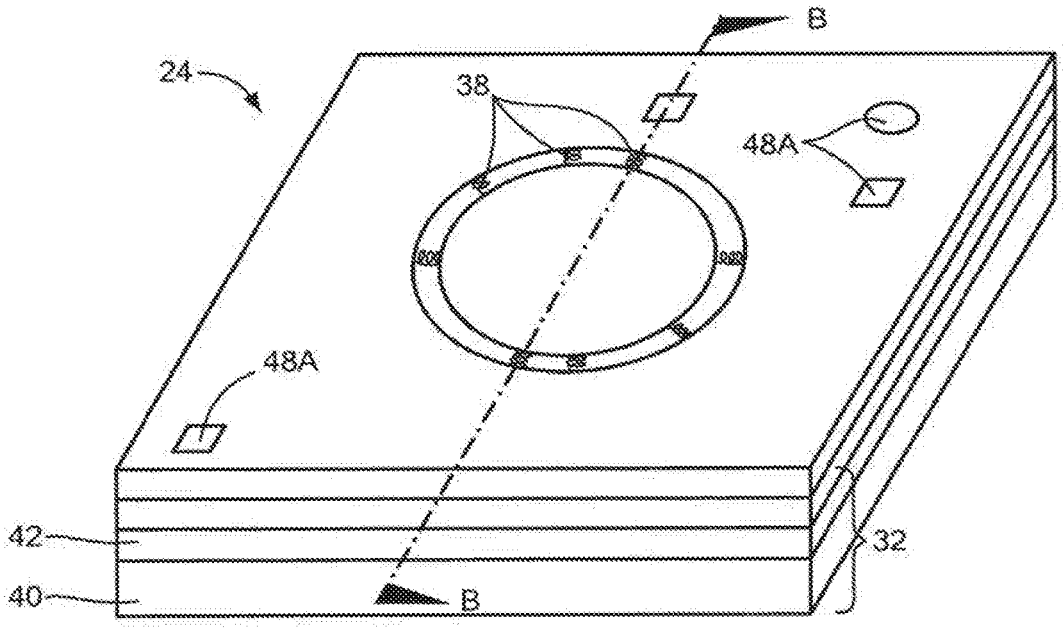
FIG. 2A schematically shows a perspective view of a MEMS microphone die may be used with illustrative embodiments of the invention.
Figure 2B:
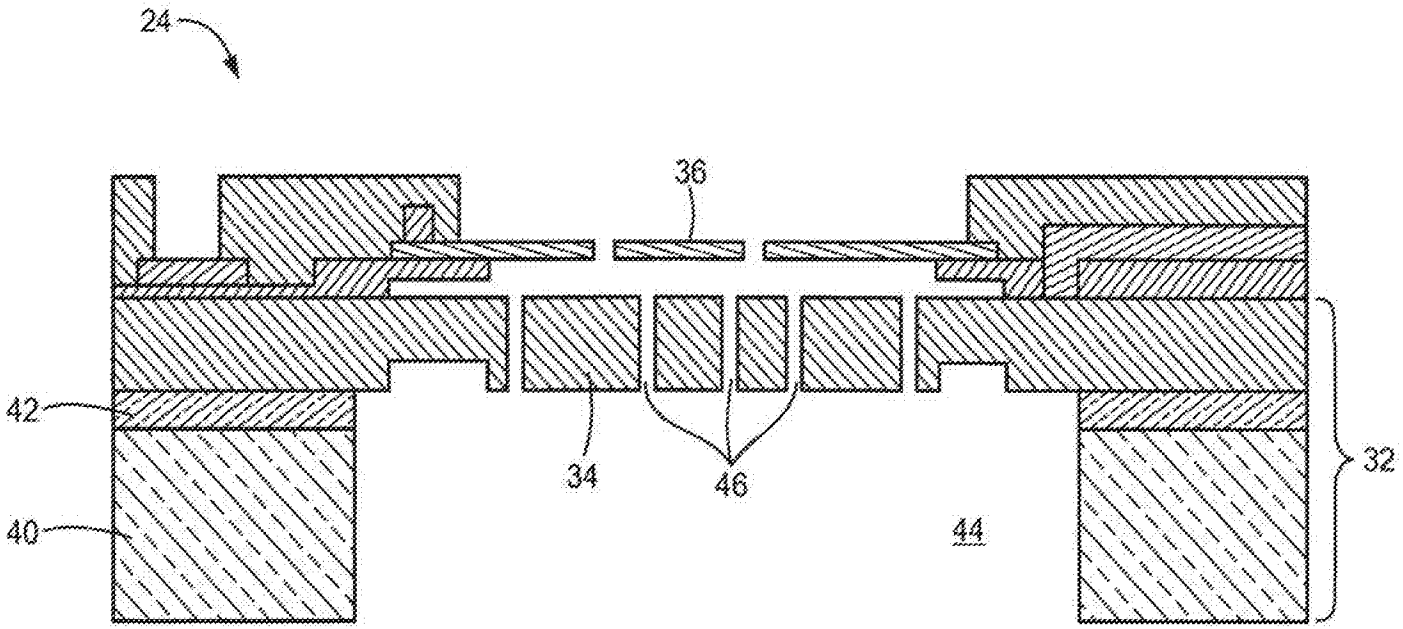
FIG. 2B schematically shows a cross-sectional view of the microphone die of FIG. 2A across line B-B.

The microphone die 24 can be implemented as any of a number of different types of microphone dies. For example, as suggested above, the microphone die 24 may be implemented as a MEMS microphone die. To that end, FIG. 2A schematically shows a top, perspective view of a MEMS microphone die 24 that may be used with illustrative embodiments of the invention. FIG. 2B schematically shows a cross-sectional view of the same MEMS microphone die 24 across line B-B of FIG. 2A. These two figures are discussed simply to detail some exemplary components that can make up a microphone die 24 used in accordance with various embodiments.

As shown in FIGS. 2A and 2B, the microphone die 24 has a chip base 32, one portion of which supports a backplate 34. The microphone die 24 also has a flexible diaphragm 36 suspended by springs 38 over, and movable relative to, the backplate 34. The backplate 34 and diaphragm 36 together form a variable capacitor. As such, the microphone is a condenser microphone. In illustrative embodiments, the backplate 34 is formed from single crystal silicon (e.g., a part of a silicon-on-insulator wafer), while the diaphragm 36 is formed from deposited polysilicon. In other embodiments, however, the backplate 34 and diaphragm 36 may be formed from different materials.

In the embodiment shown in FIGS. 2A and 2B, the chip base 32 includes the backplate 34 and other structures, such as a bottom wafer 40 and a buried oxide layer 42 of a silicon-on-insulator (i.e., a SOD wafer. A portion of the chip base 32 also forms a backside cavity 44 extending from the bottom of the chip base 32 to the bottom of the backplate 34. To facilitate operation, the backplate 34 has a plurality of through-holes 46 that lead to the backside cavity 44.

In operation, as generally noted above, audio/acoustic signals strike the diaphragm 36, causing it to vibrate, thus varying the distance between the diaphragm 36 and the backplate 34 to produce a changing capacitance. Such audio/acoustic signals may contact the microphone die 24 from any direction. For example, the audio/acoustic signals may travel upward, first through the backplate 34, and then partially through and against the diaphragm 36. As another example, the audio/acoustic signals may travel in the opposite direction.

Pads 48A on the top surface of the microphone die 24:

1) route outbound signals, such as this changing capacitance to other devices, and 2) receive incoming signals, such as power, bias, and other control signals from other devices.

It should be noted that discussion of the specific microphone die 24 is for illustrative purposes only. Other microphone die configurations thus may be used with illustrative embodiments of the invention. For example, rather than using an SOI wafer, the microphone die 24 may be formed from a bulk silicon wafer substrate, and/or the backplate 34 may be formed from a deposited material, such as deposited polysilicon. In other embodiments, the diaphragm 36 and backplate 34 may be in opposite positions so that the diaphragm 36 is positioned between the backside cavity 44 and the backplate 34. Yet other embodiments may use non-condenser microphones, such as those that rely on piezoelectric properties. Accordingly, discussion of the specific type of microphone die 24 is for illustrative purposes only.

Figure 3A:
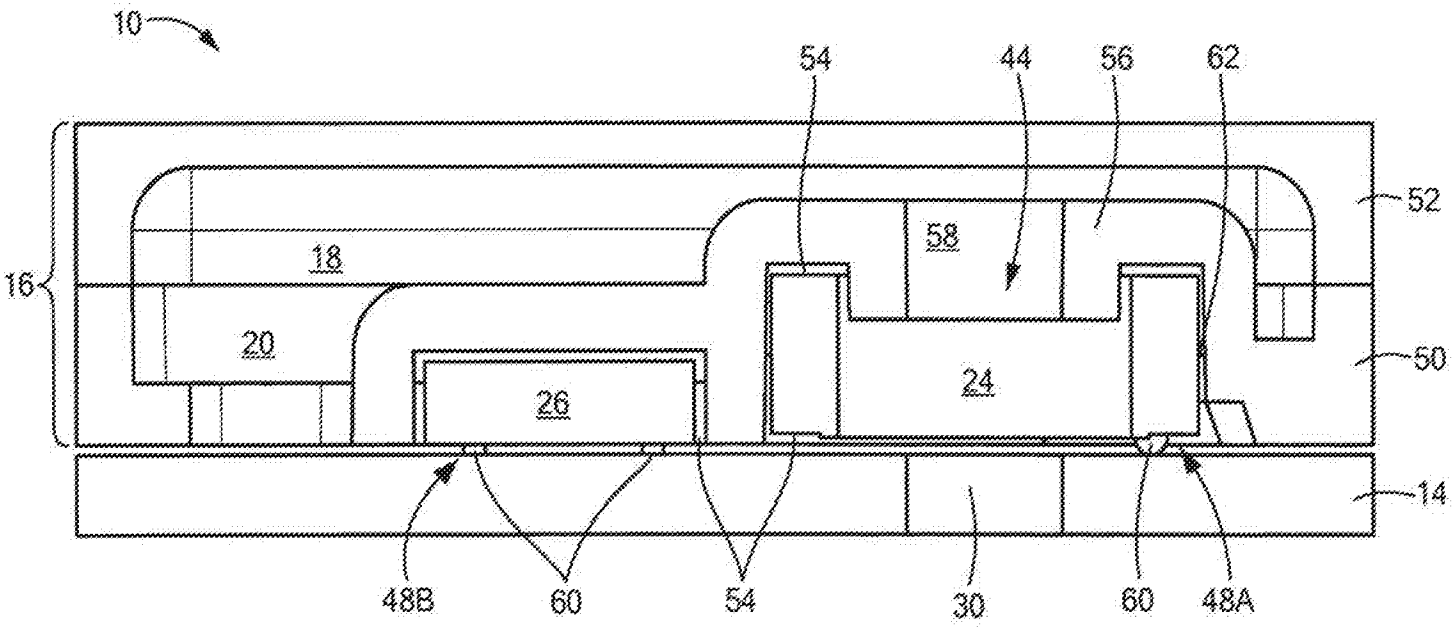
FIG. 3A schematically shows a cross-sectional view of the packaged microphone of FIG. 1B in accordance with one embodiment of the invention.
Figure 3B:
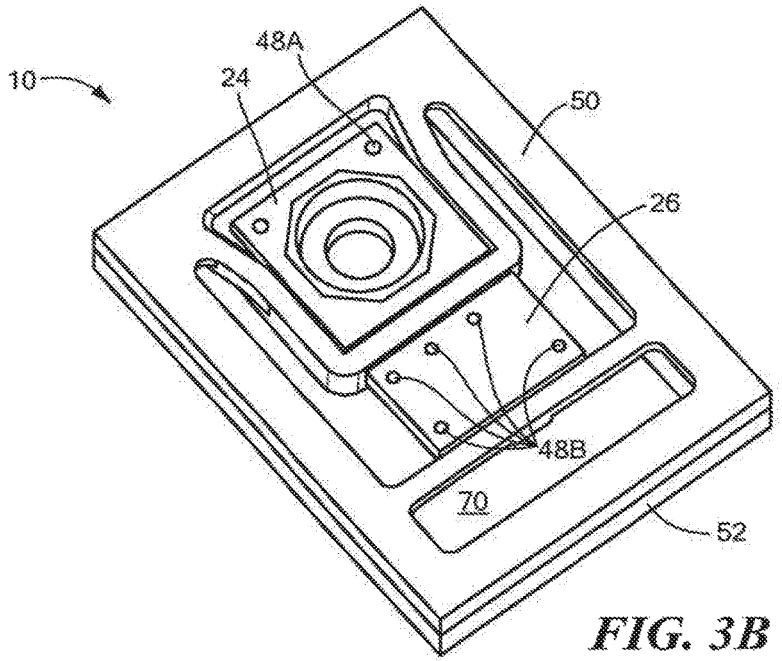
FIG. 3B schematically shows a bottom-perspective view of the packaged microphone of FIG. 3A with its bottom substrate removed to show details of the package interior.
Figure 3C:
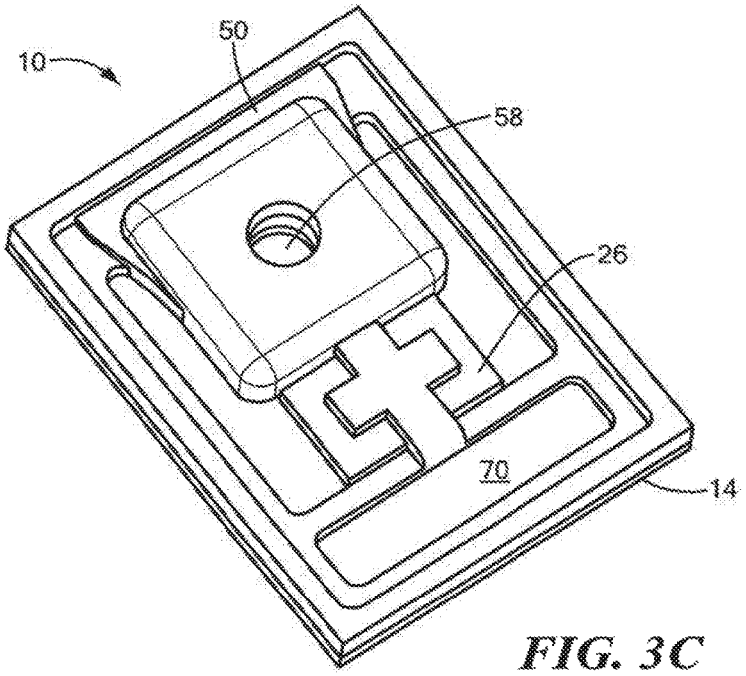
FIG. 3C schematically shows a top-perspective view of the packaged microphone of FIG. 3A with a portion of its lid structure removed to show details of the package interior.

FIG. 3A schematically shows a cross-sectional view of the packaged microphone 10 of FIG. 1B in accordance with one embodiment of the invention. In like fashion, FIG. 3B schematically shows a bottom-perspective view of the packaged microphone 10 of FIG. 3A with its bottom substrate/base 14 removed to show details of the package interior, while FIG. 3C schematically shows a top-perspective view of the packaged microphone 10 of FIG. 3A with a portion of its lid structure 16 removed to show details of the package interior. FIGS. 4A-11C have similar views and are discussed below.

The cross-sectional view of FIG. 3A more clearly shows the lid structure 16 coupled with its base 14 in accordance with this embodiment. The base 14 of this embodiment preferably is an interconnect apparatus, such as a printed circuit board (e.g., BT or FR-4), carrier substrate, or pre-molded leadframe, while the lid structure 16 is fabricated primarily from plastic. As noted above, the plastic may have conductive components to protect against electromagnetic interference.

The lid structure 16 may be formed from two separate portions; namely, a frame structure 50 (also referred to as a "frame 50") containing the dies 24 and 26, and a cover 52 for forming the interior chamber 18. More specifically, the frame 50 has various features and details, including concavities 54 for receiving the microphone die 24 in the circuit die 26. These concavities 54 are specially shaped to easily receive and register with their respective dies 24 and 26. For example, the concavity 54 receiving the microphone die 24 of FIG. 3A forms a toroidal region with a central portion 56 that extends into the backside cavity 44 of the microphone die 24. To improve performance, the central portion 56 has an opening 58 for connecting the microphone die 24 with the package back volume (discussed below).

Accordingly, using the packaged microphone 10 of FIGS. 2A and 2B, the microphone die 24 of this embodiment is mounted so that the diaphragm 36 is between the aperture 30 and the backplate 34. In other words, in this embodiment, the distance between the diaphragm 36 and the aperture 30 is smaller than the distance between the backplate 34 and the aperture 30. This favorably causes the acoustic signal to impinge upon the diaphragm 36 before passing through the backplate 34. If a high-pressure event therefore impinges upon the diaphragm 36, the backplate 34 effectively serves as a stop to protect against spring overload, which can damage the microphone die 24.

Some embodiments have more than one microphone die 24 and/or more than one circuit die 26. For example, the packaged microphone 10 can have multiple microphones for noise cancellation or increasing the desired signal. As another example, the packaged microphone 10 also can have integrated passive devices for programming and filtering. In fact, those additional dies can share a single concavity 54 with other dies, have independent concavities 54, or not be mounted within a concavity 54. Moreover, one or more of the multiple dies in a single concavity 54 can be in any of a variety of configurations, such as in parallel with the acoustic path, or, alternatively, not be exposed to the acoustic signal. Accordingly, discussion of a single microphone die 24 and circuit die 26 is for illustrative purposes only.

As discussed in greater detail below with regard to FIG. 13, pads 48A on the top face of the microphone die 24, and pads 48B on the top surface of the circuit die 26, directly physically and electrically contact corresponding pads (not shown) on the interior face of the base 14 to permit die intercommunication, and communication with external devices. Among other things, the die pads 48A and 48B may have conductive bumps or balls (both identified with reference number 60) to make that physical and electrical connection with the base 14. FIG. 3B shows these pads 48A and 48B on the top faces of the respective dies 24 and 26. Accordingly, the frame 50 effectively permits a flip-chip type connection without requiring expensive flip-chip equipment.

The package 12 also has a seal 62 between the microphone die 24 and some portion of the package 12. For example, the seal 62 may be positioned between the microphone die 24 in the lid structure 16 (e.g., between the microphone die 24 and the inner walls of its concavity 54), and/or be between the microphone die 24 and the substrate. In either case, the seal 62 divides the interior chamber 18 into a front volume (i.e., the volume defined at least in part by the aperture 30 and a portion of the diaphragm 36 facing the aperture 30) and a back volume (i.e., the volume defined at least in part by the portion of the diaphragm 36 not facing the aperture 30—the rest of the interior chamber 18). In illustrative embodiments, the seal 62 is formed from an adhesive material securing the microphone die 24 to the recess within the lid structure 16. In other embodiments, the seal 62 may be a separate component, such as an O-ring, sealing the microphone die 24.

To maximize back volume, illustrative embodiments reduce the amount of plastic material of the frame 50 within the interior chamber 18. To that end, the frame 50 in this embodiment may be considered to have a plurality of volume enlarging regions 70 (see FIGS. 3B and 3C for the extent of their breadth) that directly communicate the top interior surface of the cover 52 with the top surface of the base 14. In addition, the bottom surfaces of the concavities 54 are not necessarily solid and do not necessarily have the same area as the surface area of the faces of the dies 24 and 26 that they support. For example, as shown in FIG. 3C, the circuit die 26 extends beyond the edge of the plastic shelf supporting it. Other embodiments may form holes through the otherwise solid shelf, or may use a cross structure.

As noted above, illustrative embodiments form the lid structure 16 from two separate components; namely a frame structure 50 and a cover 52. In this embodiment, both the frame structure 50 and cover 52 are formed primarily from elastomeric material, such as plastic. Of course, as noted above, these structures may be treated to block/mitigate electromagnetic interference within the interior chamber 18. One or both of the frame structure 50 and cover 52 nevertheless may be formed by different or like conventional processes, such as injection molding processes or 3D printing processes. Use of these precision technologies permits very tight tolerances, improving fabrication efficiencies and yield, while maximizing back volumes.

After they are formed separately, other conventional connection processes secure the two components together to form a substantially unitary lid structure 16. Among other things, those connection processes may use adhesives, ultrasonic welding, laser welding, or thermal-sonic welding to weld the downwardly extending walls of the cover 52 to the side walls 20 of the frame 50. Other embodiments, however, may form the lid structure 16 as a single component. For example, conventional 3D printing processes or other processes may form the lid structure 16 in this manner.

Accordingly, during use, acoustic signals pass through the aperture 30 in the base 14 and strike the microphone die 24. This causes the diaphragm 36 to vibrate, producing a variable capacitance signal that is routed to the circuit die 26 via pads 48A, balls/bumps 60, and interconnects through the base 14. The circuit die 26 processes and forwards these signals through interconnects and pads 28 in the base 14 to external devices.

The embodiments of FIGS. 3A through 3C show just one of a variety of implementations. FIGS. 4A-11C schematically show a variety of other embodiments that differ in some respect from the embodiments discussed above. Of course, those skilled in the art can combine features of various embodiment and still remain within the scope of illustrative embodiments of the invention. Accordingly, each of these discussed embodiments is for illustration purposes only and not intended to limit all embodiments.

In a manner similar to the embodiment shown in FIGS. 3A-3C, FIGS. 4A-4C also show a bottom port microphone with a frame structure 50 and base 14 formed from circuit board material. Like FIGS. 3B and 3C, FIGS. 4B and 4C have outside package portions removed to show the interior of the package 12. This embodiment, however, has a cover 52 that is generally flat and a frame 50 with higher side walls 20 to compensate for the flat cover 52. The shape of the concavities 54 in the frame 50 also differ to some extent. For example, the area of the frame portion supporting the circuit die 26 is the same size as, or larger than, that of the corresponding area of the circuit die 26.

Figure 4A:
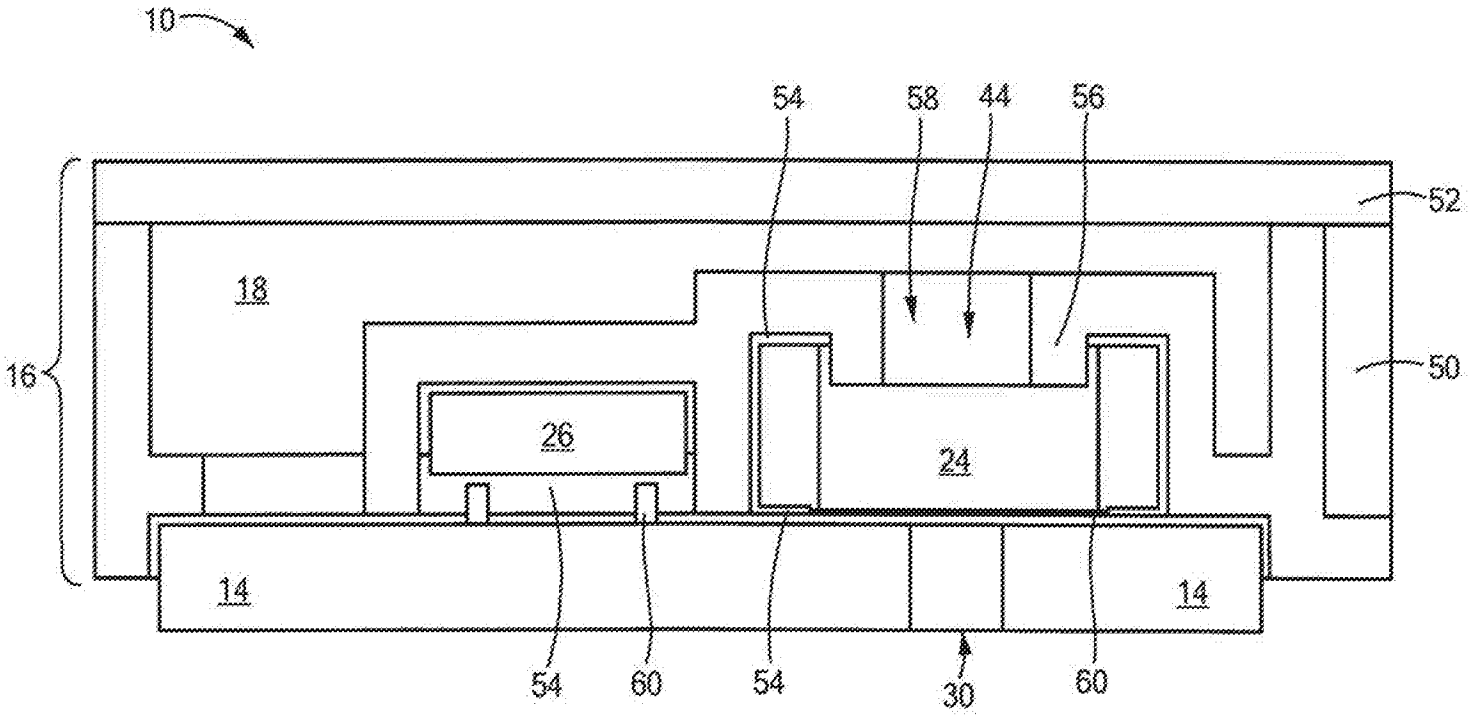
FIG. 4A schematically shows a cross-sectional view of the packaged microphone of FIG. 1B in accordance with another embodiment of the invention.
Figure 4B:
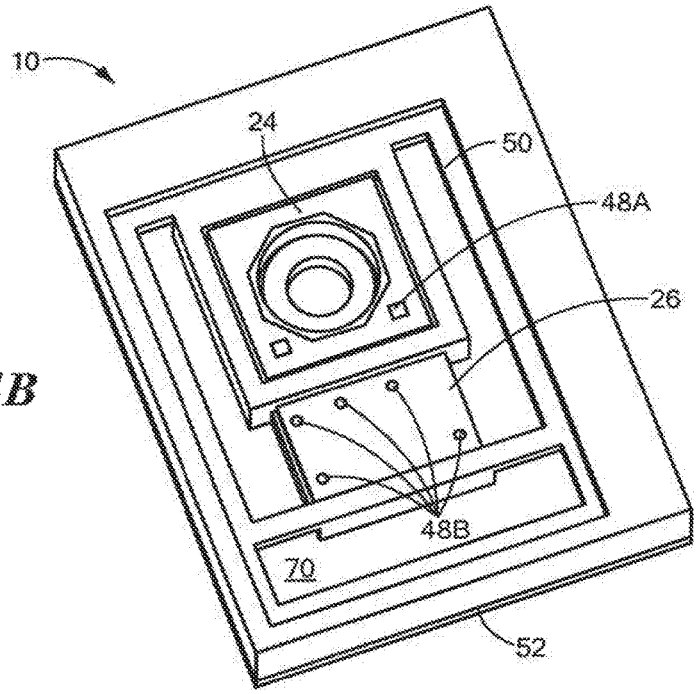
FIG. 4B schematically shows a bottom-perspective view of the packaged microphone of FIG. 4A with its bottom substrate removed to show details of the package interior.
Figure 4C:
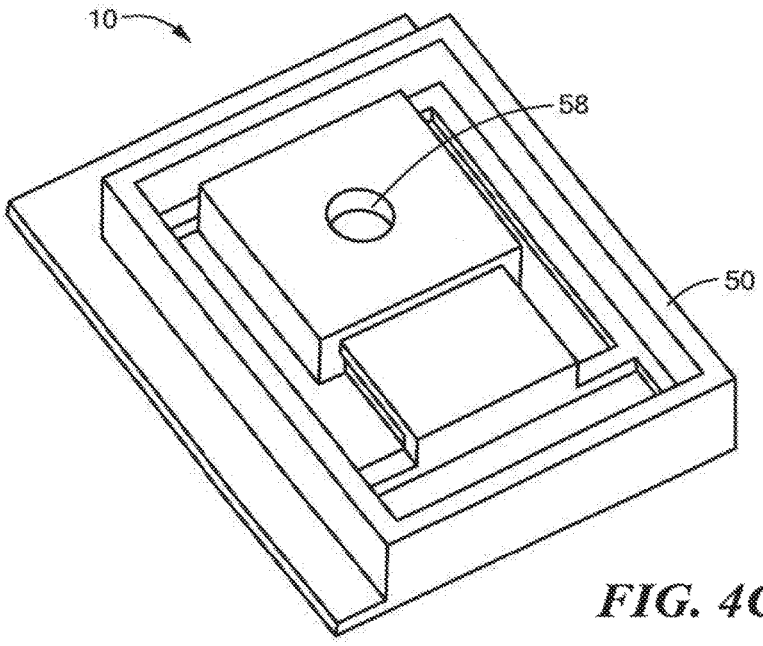
FIG. 4C schematically shows a top-perspective view of the packaged microphone of FIG. 4A with a portion of its lid structure removed to show details of the package interior.
Figure 5A:
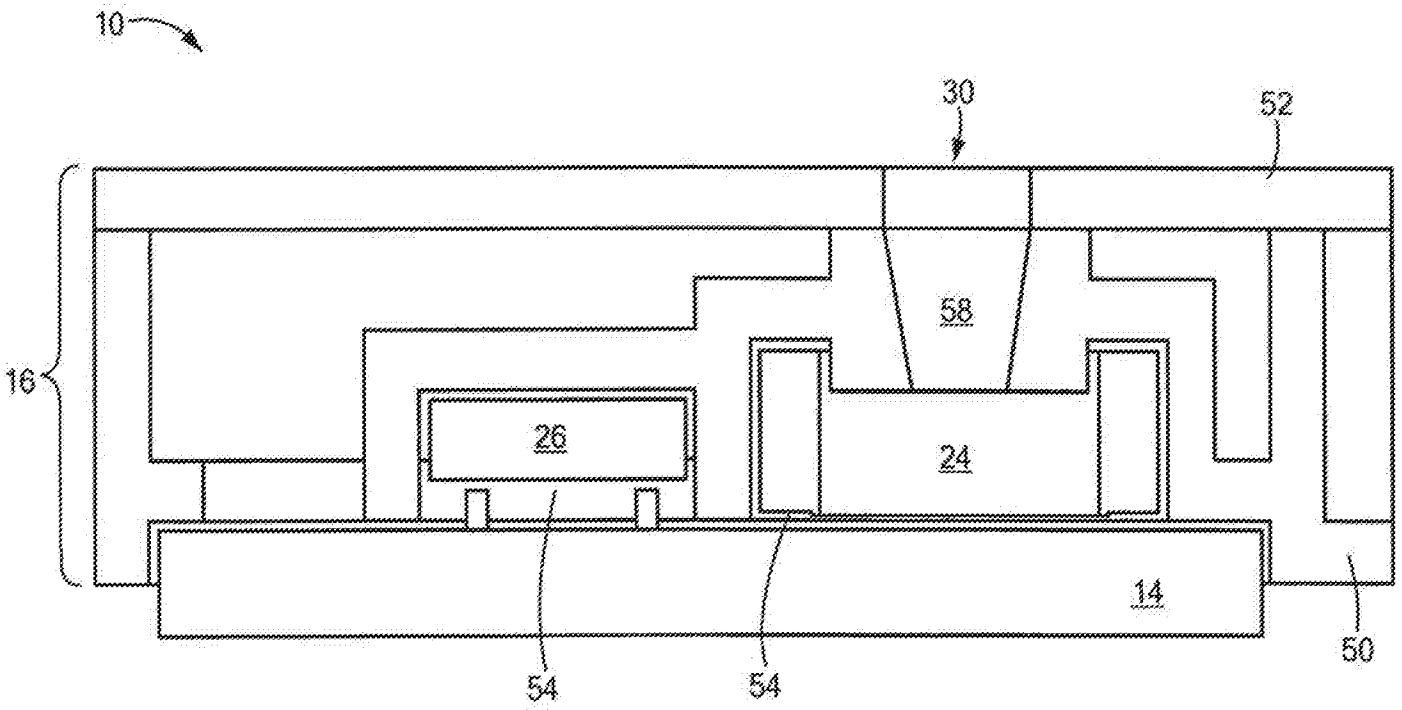
FIG. 5A schematically shows a cross-sectional view of the packaged microphone of FIG. 1A in accordance with another embodiment of the invention.
Figure 5B:
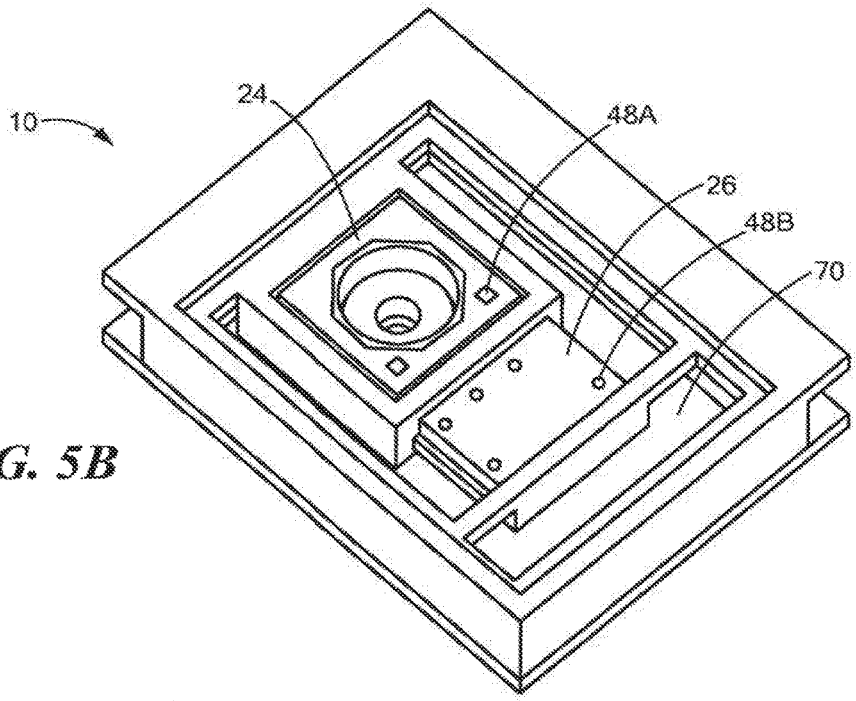
FIG. 5B schematically shows a bottom-perspective view of the packaged microphone of FIG. 5A with its bottom substrate removed to show details of the package interior.
Figure 5C:
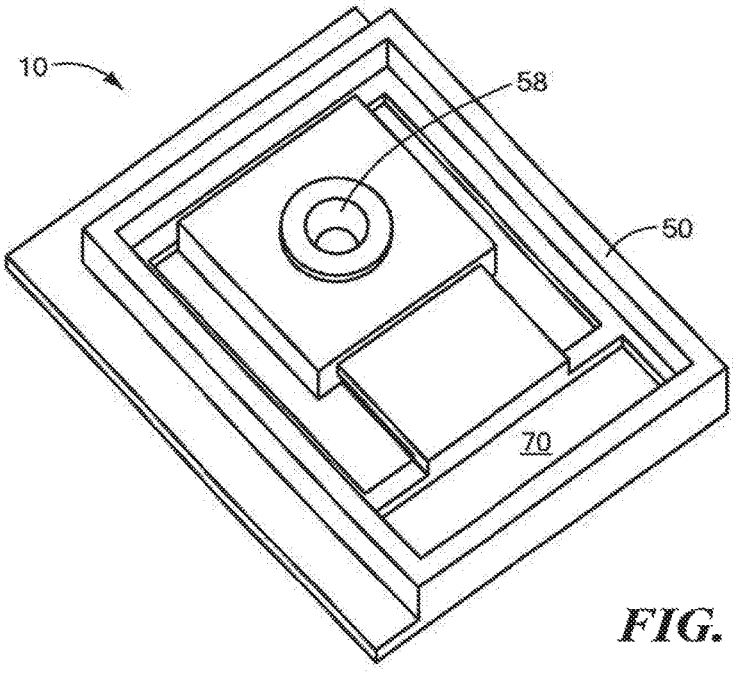
FIG. 5C schematically shows a top-perspective view of the packaged microphone of FIG. 5A with a portion of its lid structure removed to show details of the package interior.

The embodiments of FIGS. 5A-5C are substantially similar to the embodiments of FIGS. 4A-4C, but with a top aperture 30. Like prior similarly shown figures, FIGS. 5B and 5C have outside package portions removed to show the interior of the package 12. Accordingly, FIGS. 5A-5C show a top port version of the packaged microphone 10 of FIGS. 4A-4C. To that end, the frame 50 forms an opening/channel 58 that directs input acoustic signals from the aperture 30 to the microphone die 24. Although FIG. 5A shows this channel as being tapered, this channel also may be uniformly dimensioned, or have some other cross-sectional dimension. Also unlike the embodiments of FIGS. 3A-4C, this embodiment passes the acoustic signal through the backplate 34 before striking the diaphragm 36 of the microphone die 24. Moreover, this configuration can produce a relatively small back volume. To compensate for this, the frame 50 and/or base 14 may be configured to expose the region between the diaphragm 36 and the substrate to a larger volume. This may entail sealing the acoustic path formed through the channel and the microphone die 24, thus producing a relatively small front volume.

Figure 6A:
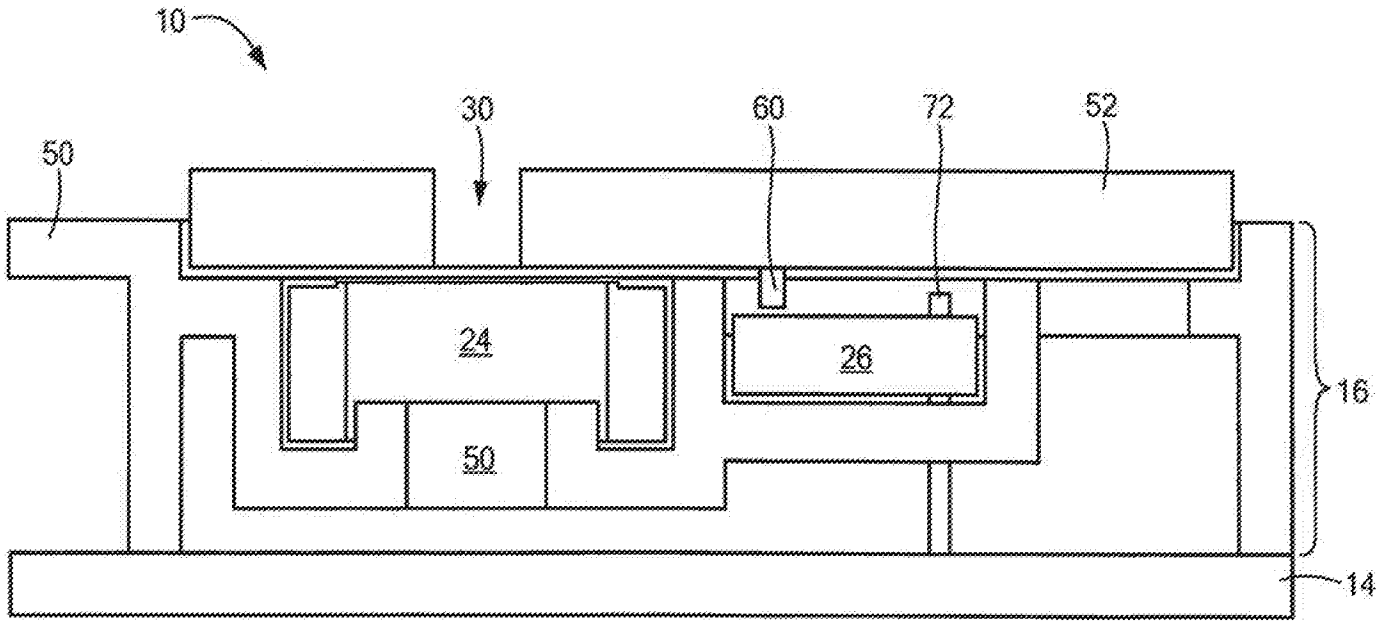
FIG. 6A schematically shows a cross-sectional view of the packaged microphone of FIG. 1A in accordance with another embodiment of the invention.
Figure 6B:
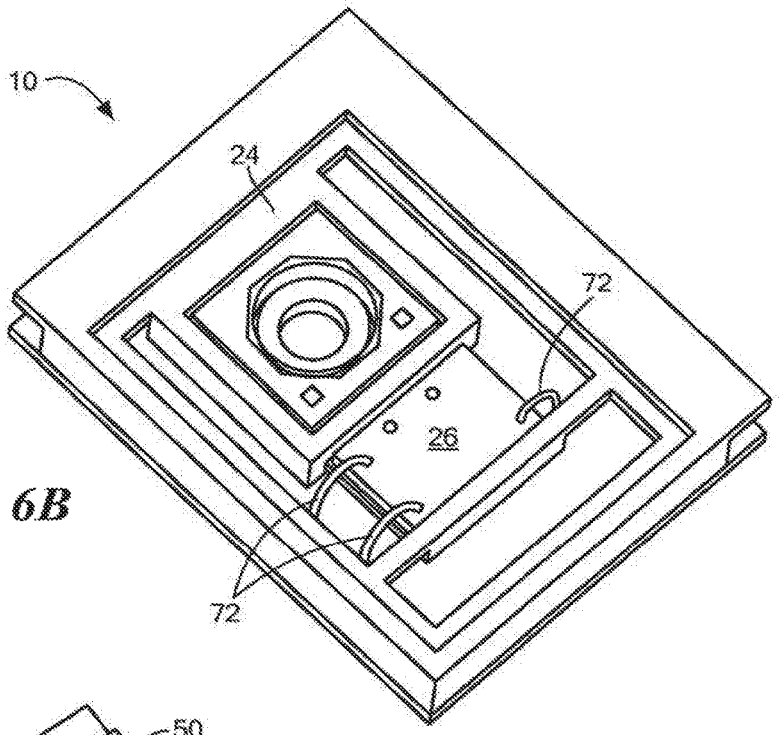
FIG. 6B schematically shows a top-perspective view of the packaged microphone of FIG. 6A with a portion of its lid structure removed to show details of the package interior.
Figure 6C:
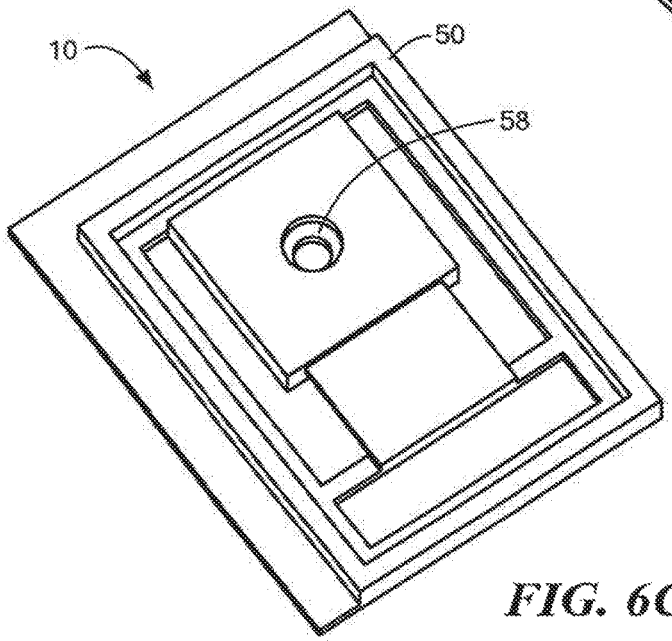
FIG. 6C schematically shows a bottom-perspective view of the packaged microphone of FIG. 6A with a portion of its substrate removed to show details of the package interior.

FIGS. 6A-6C schematically show another top port embodiment of the invention. Like prior similarly shown figures, FIGS. 6B and 6C have outside package portions removed to show the interior of the package 12. In particular, this embodiment has a cover 52 formed of interconnect material, such as a printed circuit board. Accordingly, the top and bottom of the packaged microphone 10 can have interconnects and pads 28. Like some other embodiments, this embodiment mounts the microphone die 24 so that its backplate 34 acts as a diaphragm stop. Moreover, unlike the embodiment shown in FIG. 3A, the circuit die 26 uses wirebonds 72 to connect with its base 14, and its pads 48B connect directly with its interconnecting cover 52. The pads 48A on the microphone die 24 also connect directly with the cover 52. Accordingly, the two dies 24 and 26 can be configured to communicate directly through the interconnect structure(s) of the cover 52 in the lid structure 16. As noted, some implementations may form external pads 28 on the cover 52 and thus, use this embodiment as a bottom port microphone.

Figure 7A:
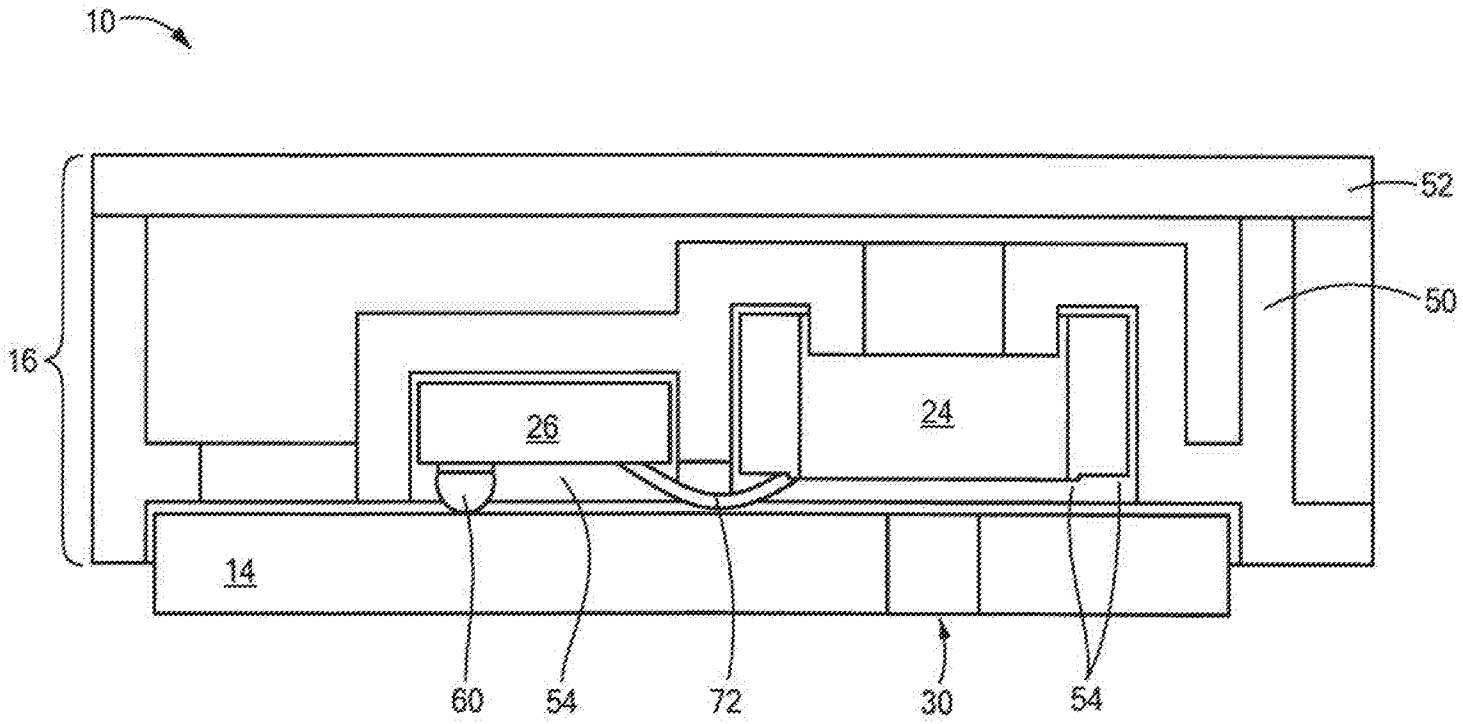
FIG. 7A schematically shows a cross-sectional view of the packaged microphone of FIG. 1B in accordance with another embodiment of the invention.
Figure 7B:
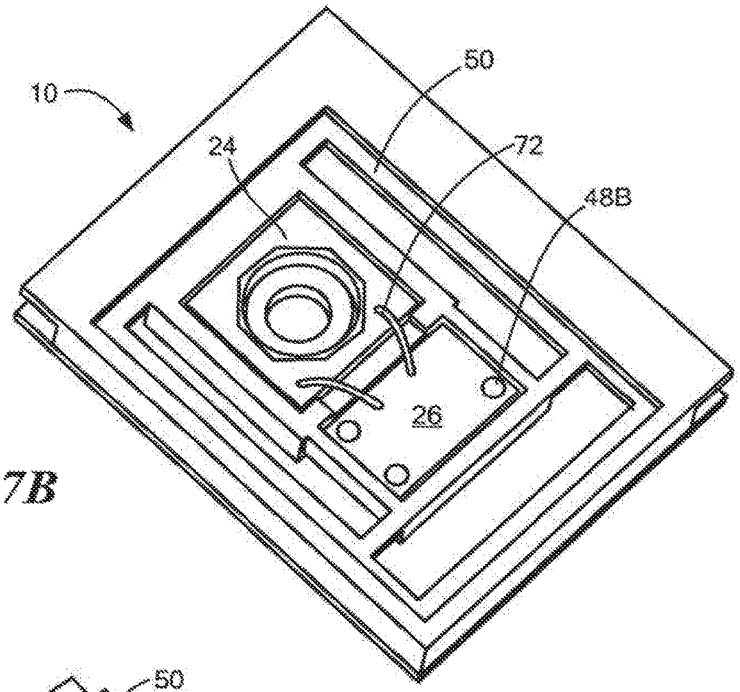
FIG. 7B schematically shows a bottom-perspective view of the packaged microphone of FIG. 7A with its bottom substrate removed to show details of the package interior.
Figure 7C:
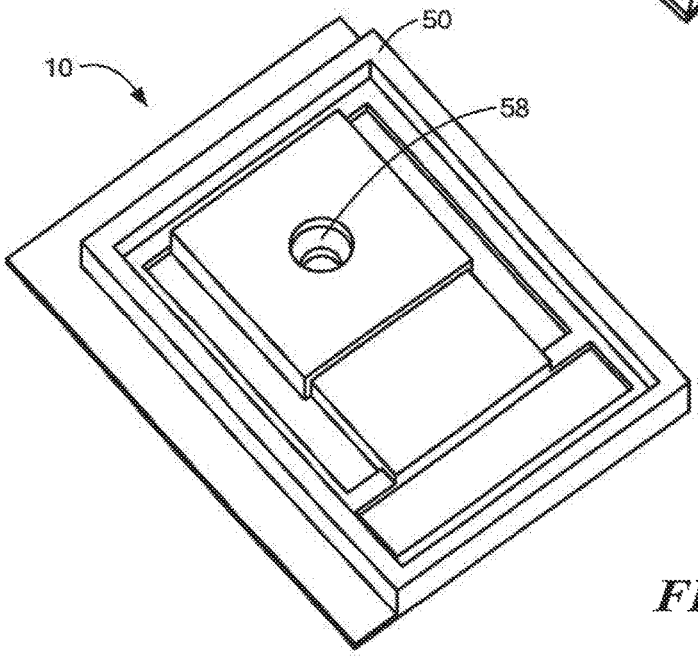
FIG. 7C schematically shows a top-perspective view of the packaged microphone of FIG. 7A with a portion of its lid structure removed to show details of the package interior.

FIGS. 7A-7C schematically show another embodiment that is very similar to that shown in FIGS. 4A-4C. Like FIGS. 3B and 3C, FIGS. 7B and 7C have outside package portions removed to show the interior of the package 12. Specifically, both embodiments shown in FIGS. 4A-4C and FIGS. 7A-7C are bottom port designs with an electrical interconnect apparatus as a base 14 and a lid structure 16 primarily formed from plastic. Rather than directly connecting the microphone die 24 to the base 14, however, this embodiment uses one or more wirebonds 72 to electrically connect the microphone die 24 with the circuit die 26. Accordingly, the microphone die 24 does not directly contact or electrically connect directly with the base 14. Instead, bias signals and variable capacitance signals transmit between the base 14 and microphone die 24 through the wirebond 72 and circuit die 26.

Figure 8A:
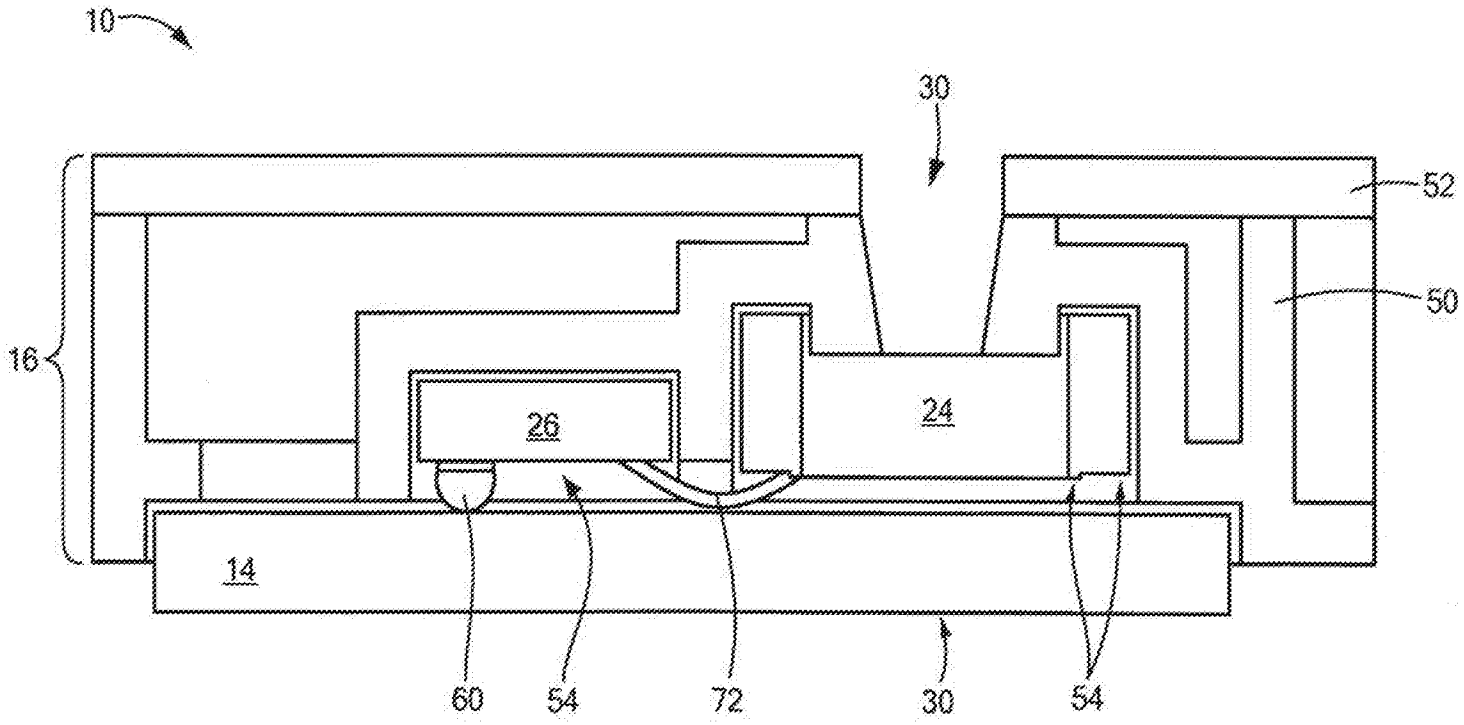
FIG. 8A schematically shows a cross-sectional view of the packaged microphone of FIG. 1A in accordance with another embodiment of the invention.
Figure 8B:
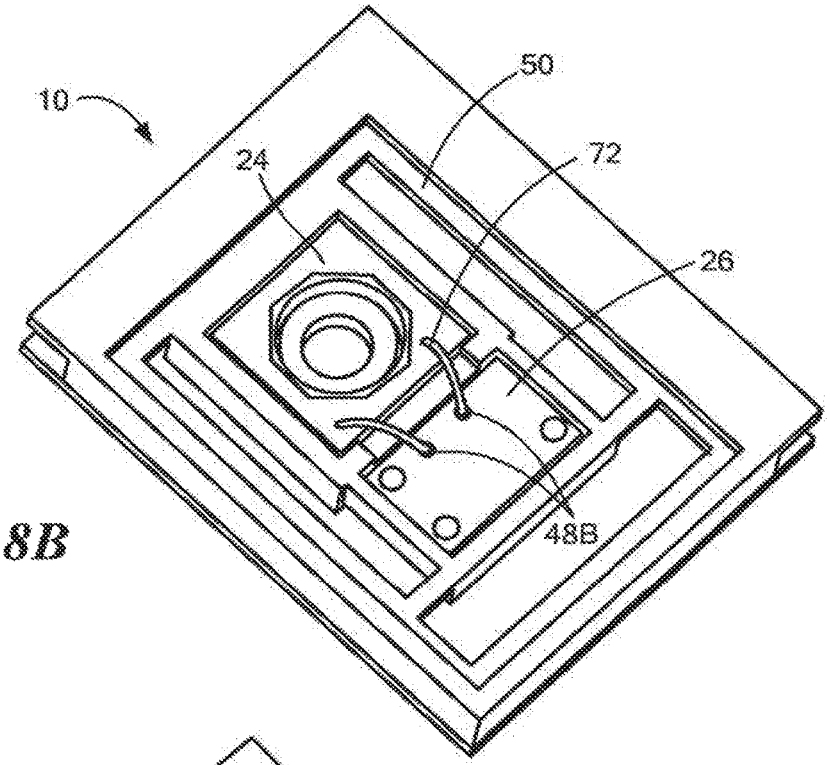
FIG. 8B schematically shows a bottom-perspective view of the packaged microphone of FIG. 8A with its bottom substrate removed to show details of the package interior.
Figure 8C:
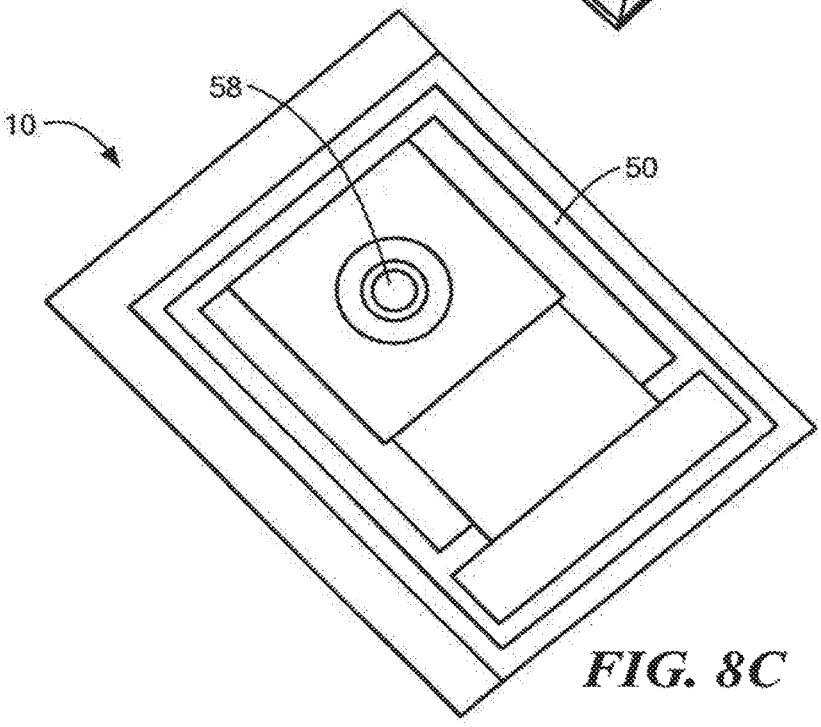
FIG. 8C schematically shows a top-perspective view of the packaged microphone of FIG. 8A with a portion of its lid structure removed to show details of the package interior.

FIGS. 8A-8C schematically show another embodiment that is very similar to that shown in FIGS. 5A-5C. Like prior similar shown figures, FIGS. 8B and 8C have outside package portions removed to show the interior of the package 12. Specifically, both embodiments shown in FIGS. 5A-5C and FIGS. 8A-8C are top port designs with an electrical interconnect apparatus as a base 14 and a lid structure 16 primarily formed from plastic. Rather than directly connecting the microphone die 24 to the base 14, however, this embodiment uses one or more wirebonds 72 to electrically connect the microphone die 24 with the circuit die 26. Accordingly, like the embodiment shown in FIGS. 7A-7C, the microphone die 24 does not directly contact or electrically connect with the base 14. Instead, bias signals and variable capacitance signals transmit between the base 14 and microphone die 24 through the wirebond 72 and circuit die 26.

Figure 9A:
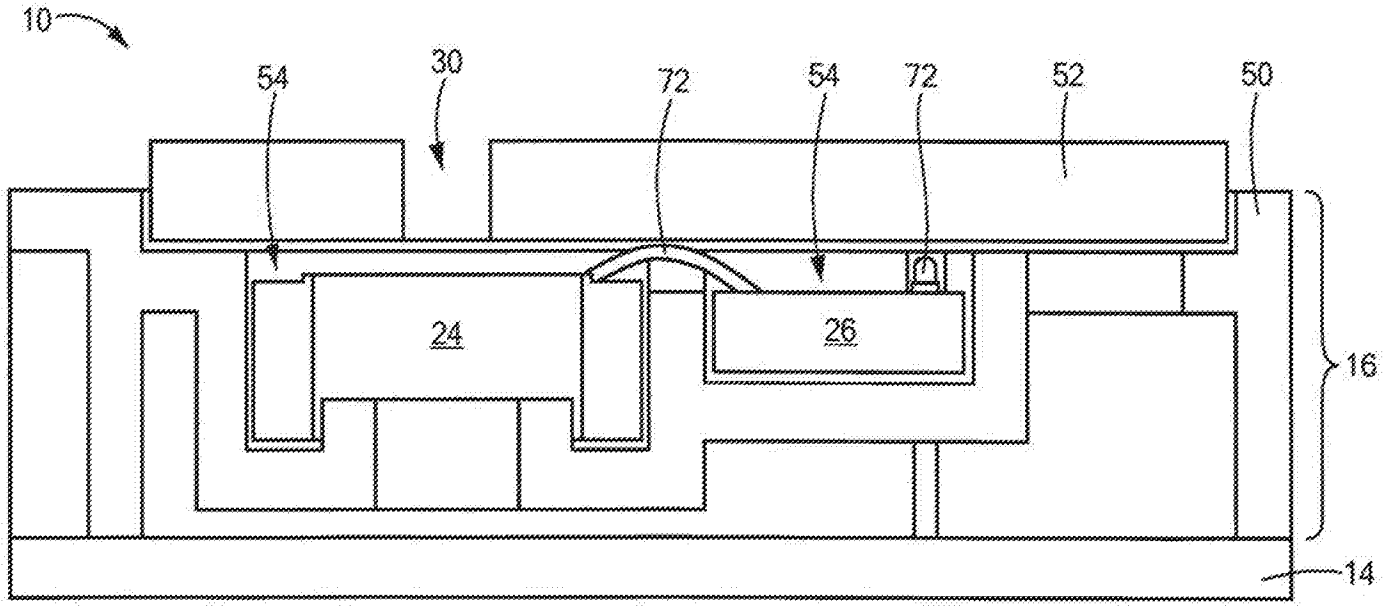
FIG. 9A schematically shows a cross-sectional view of the packaged microphone of FIG. 1A in accordance with another embodiment of the invention.
Figure 9B:
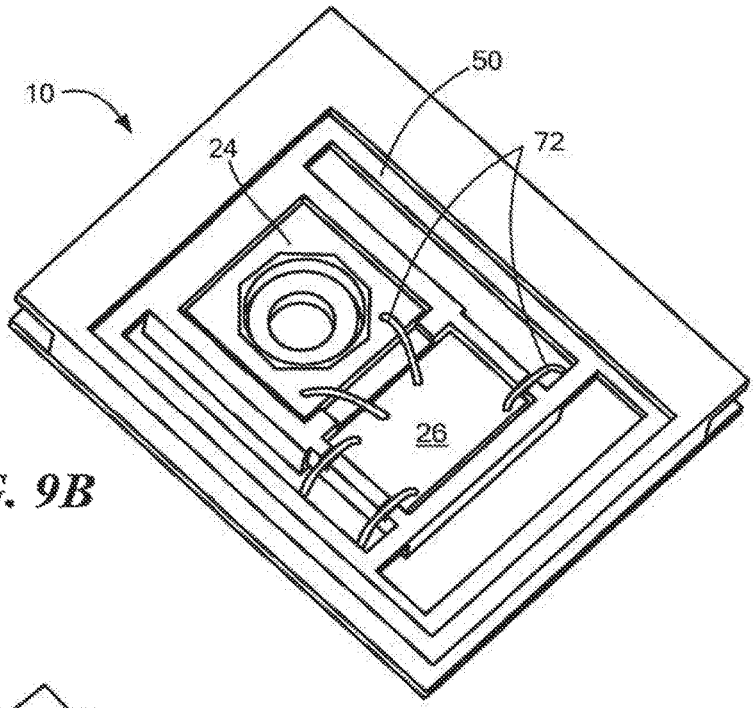
FIG. 9B schematically shows a top-perspective view of the packaged microphone of FIG. 9A with its lid structure removed to show details of the package interior.
Figure 9C:
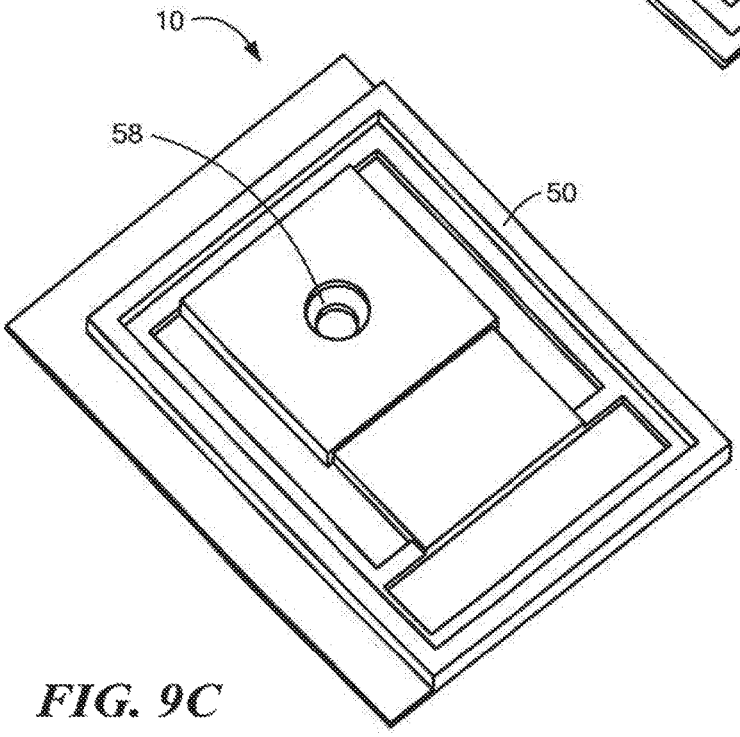
FIG. 9C schematically shows a bottom-perspective view of the packaged microphone of FIG. 9A with a portion of its substrate removed to show details of the package interior.

FIGS. 9A-9C schematically show another embodiment that is very similar to that shown in FIGS. 6A-6C. Like prior similar shown figures, FIGS. 9B and 9C have outside package portions removed to show the interior of the package 12. Specifically, both embodiments are top port designs that have a lid structure 16 with an interconnection apparatus. The primary difference is similar to the differences between FIGS. 7A and 8A and their respective similar designs. Specifically, rather than directly connecting the microphone die 24 to the cover 52, this embodiment uses one or more wirebonds 72 to electrically connect the microphone die 24 with the circuit die 26. Accordingly, like the embodiment shown in FIGS. 7A-7C and 8A-8C, the microphone die 24 of this embodiment does not directly contact or electrically connect with the base 14 or lid structure 16. Instead, bias signals and variable capacitance signals transmit between the base 14 and microphone die 24 through the wirebond 72 and circuit die 26.

Figure 10A:
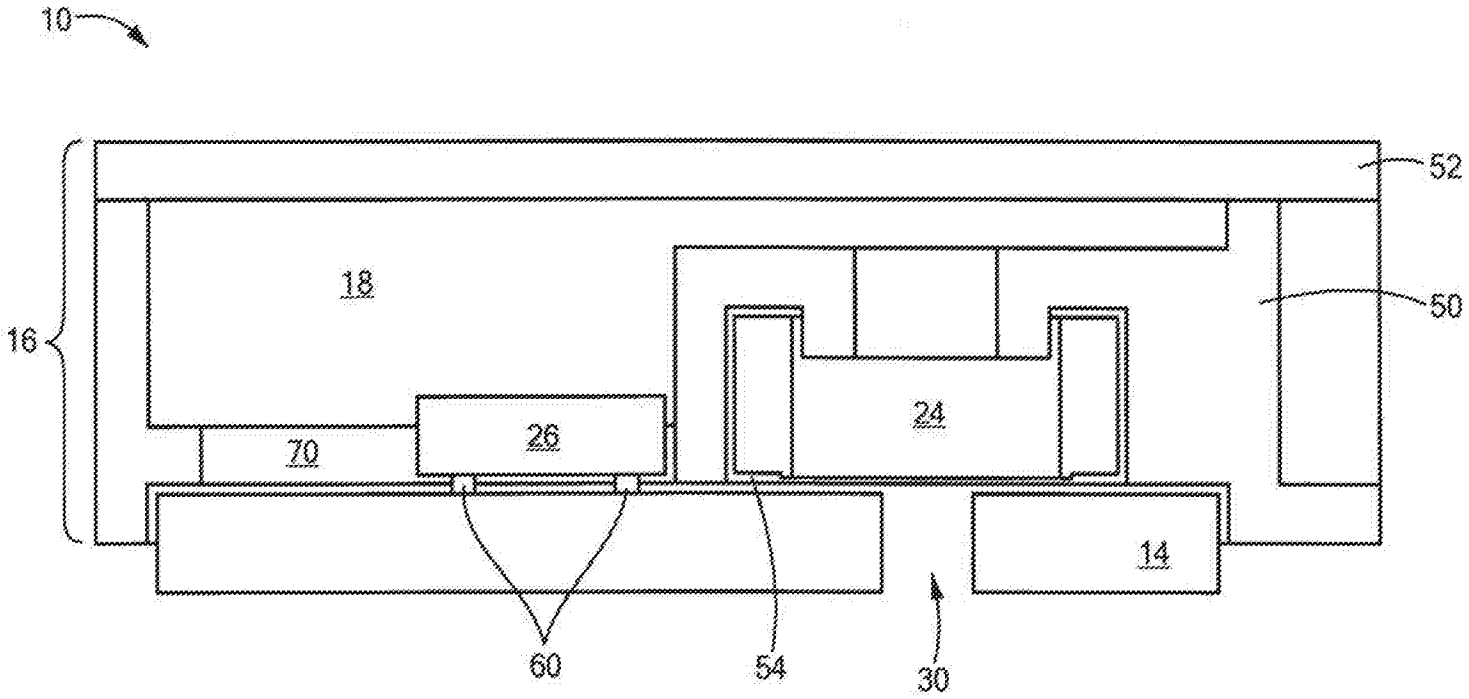
FIG. 10A schematically shows a cross-sectional view of the packaged microphone of FIG. 1B in accordance with another embodiment of the invention.
Figure 10B:
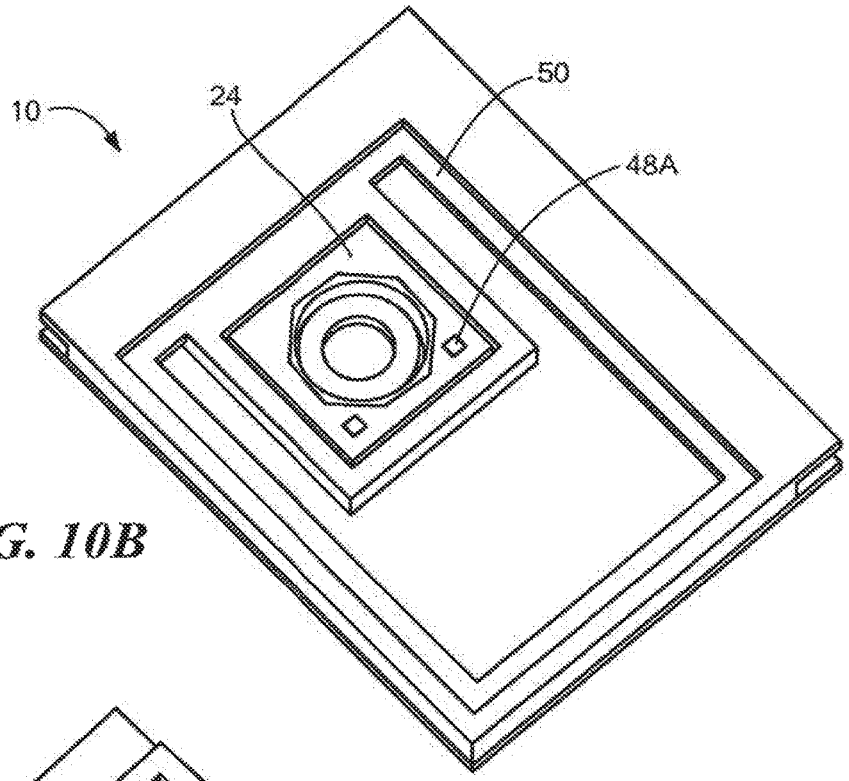
FIG. 10B schematically shows a bottom-perspective view of the packaged microphone of FIG. 10A with its substrate removed to show details of the package interior.
Figure 10C:
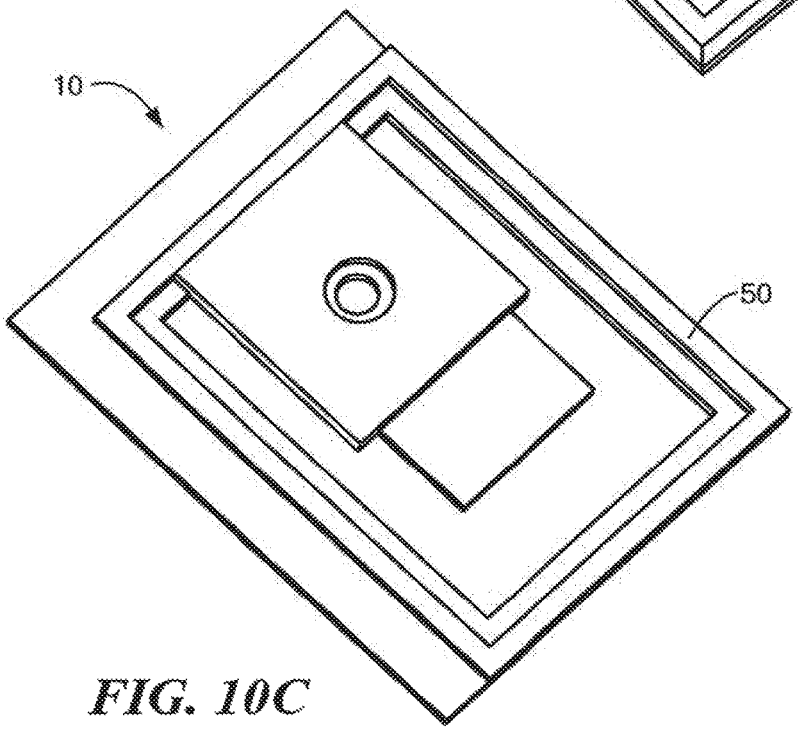
FIG. 10C schematically shows a top-perspective view of the packaged microphone of FIG. 10A with a portion of its lid structure removed to show details of the package interior.
Figure 11A:
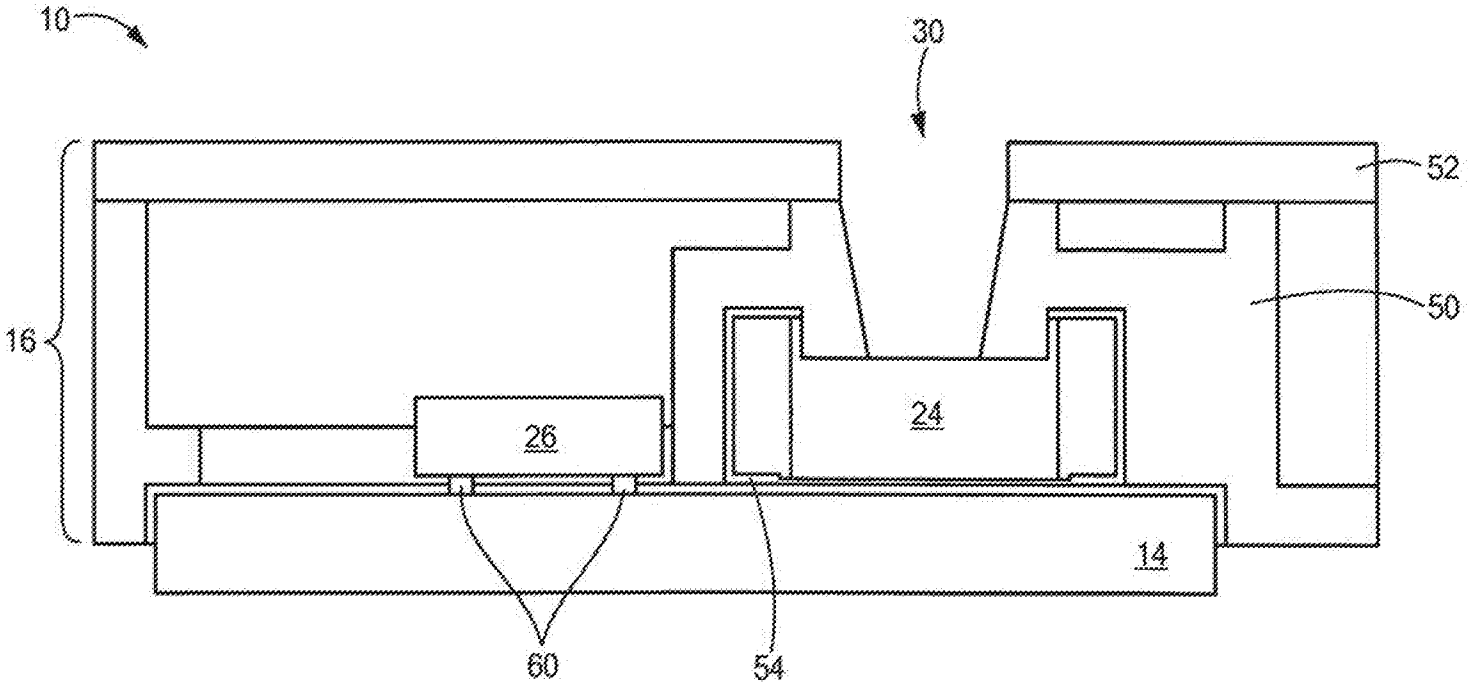
FIG. 11A schematically shows a cross-sectional view of the packaged microphone of FIG. 1A in accordance with another embodiment of the invention.
Figure 11B:
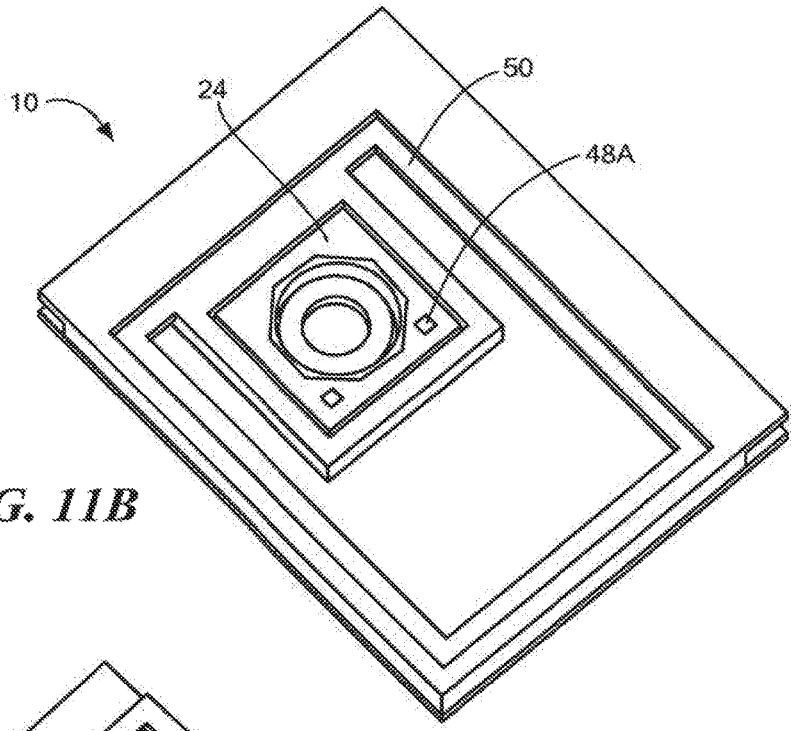
FIG. 11B schematically shows a bottom-perspective view of the packaged microphone of FIG. 11A with its substrate removed to show details of the package interior.
Figure 11C:
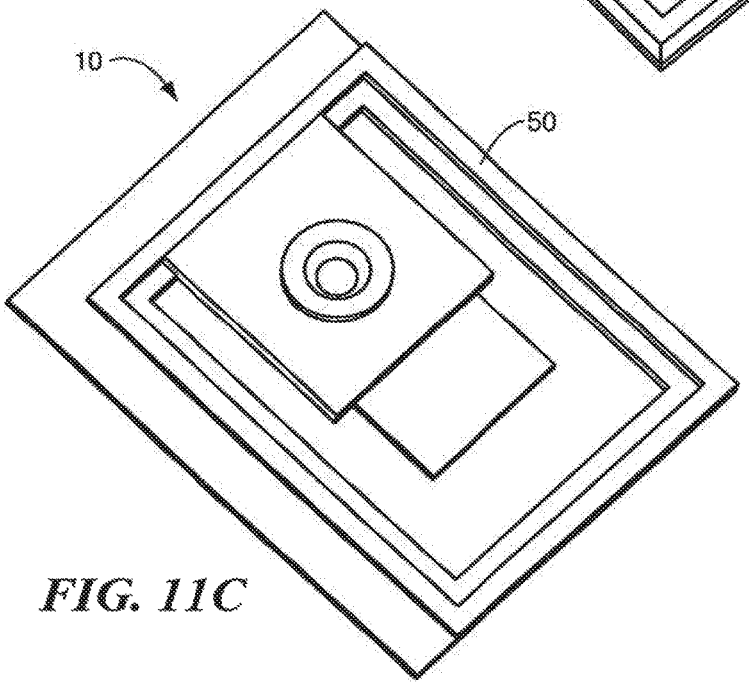
FIG. 11C schematically shows a top-perspective view of the packaged microphone of FIG. 11A with a portion of its lid structure removed to show details of the package interior.

FIGS. 10A-10C schematically show another embodiment that is similar to various embodiments discussed above. Like prior similar shown figures, FIGS. 10B and 10C have outside package portions removed to show the interior of the package 12. In this bottom-port embodiment, the circuit die 26 is directly mounted to the base 14, while the frame structure 50 mounts the circuit die 26 in a manner similar to other embodiments discussed above (i.e., within a concavity 54). Accordingly, the frame structure 50 of this embodiment does not have a recess for mounting the circuit die 26. FIGS. 11A-11C show a similar embodiment, but as a top port design.

It should be reiterated that those skilled in the art may combine features of various embodiments. For example, the embodiments of FIGS. 10A and 11A may use wirebonds 72 to connect with their underlying interconnect apparatus. As another example, the frames 50 of the embodiments of FIGS. 10A and 11A may have concavities 54 for receiving the circuit chip only, while the microphone die 24 is mounted directly to the base 14. Accordingly, discussion of specific arrangements of components is not intended to limit all embodiments.

Figure 12:
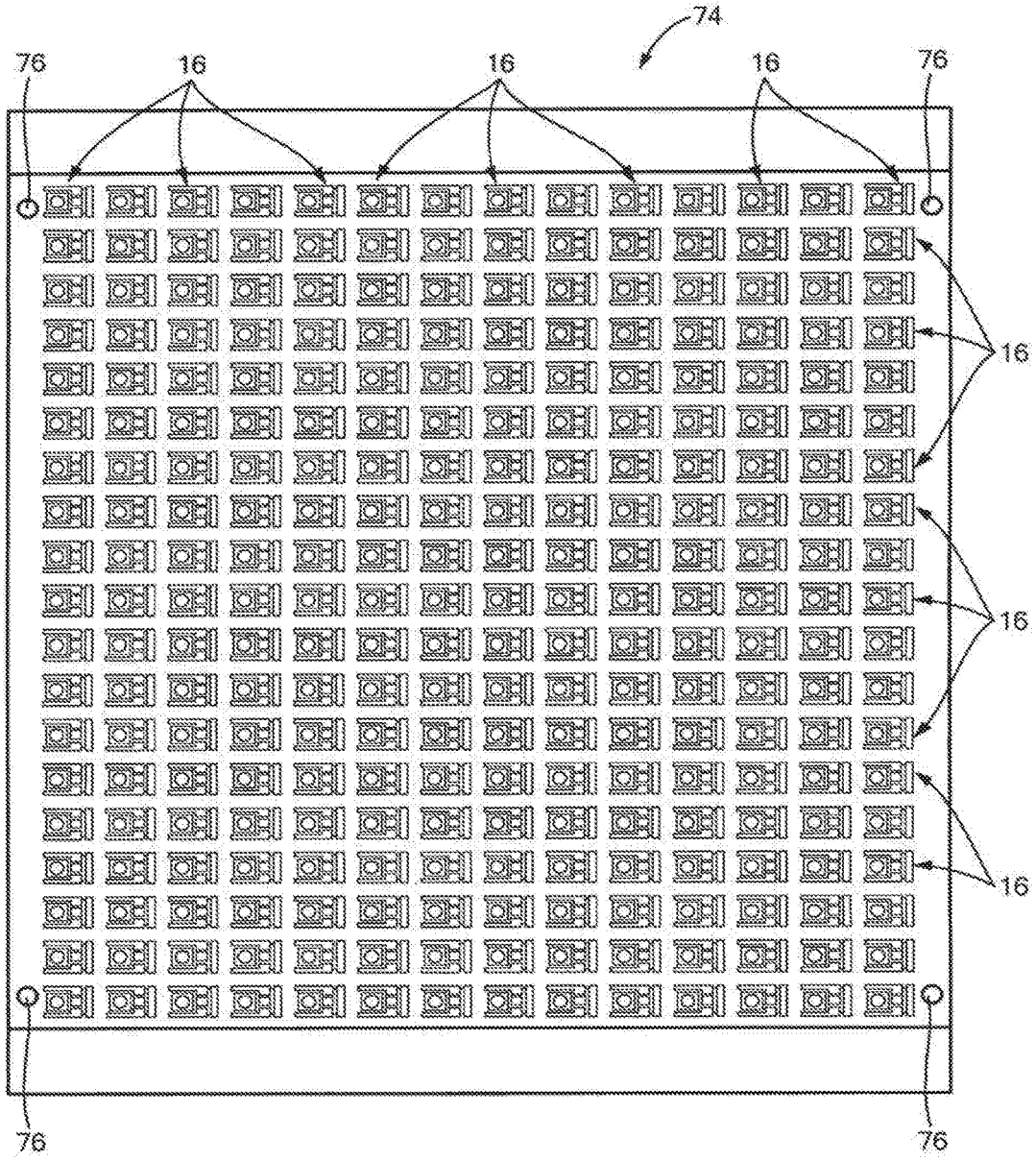
FIG. 12 schematically shows a plan view of a panel of assemblies that may be used to produce the packaged microphone of FIG. 1A in accordance with illustrative embodiments of the invention.

Among other benefits, various embodiments are easily adaptable to batch processing. To that end, two dimensional arrays of packages 12 may be fabricated at the same time, and separated by conventional dicing operations. FIG. 12 schematically shows a panel 74 having an array of lid structures 16 ready for processing in this manner. As shown, the panel 74 has a plurality of regions (i.e., individual lid structures 16) that each ultimately form an individual package 12.

Figure 13:
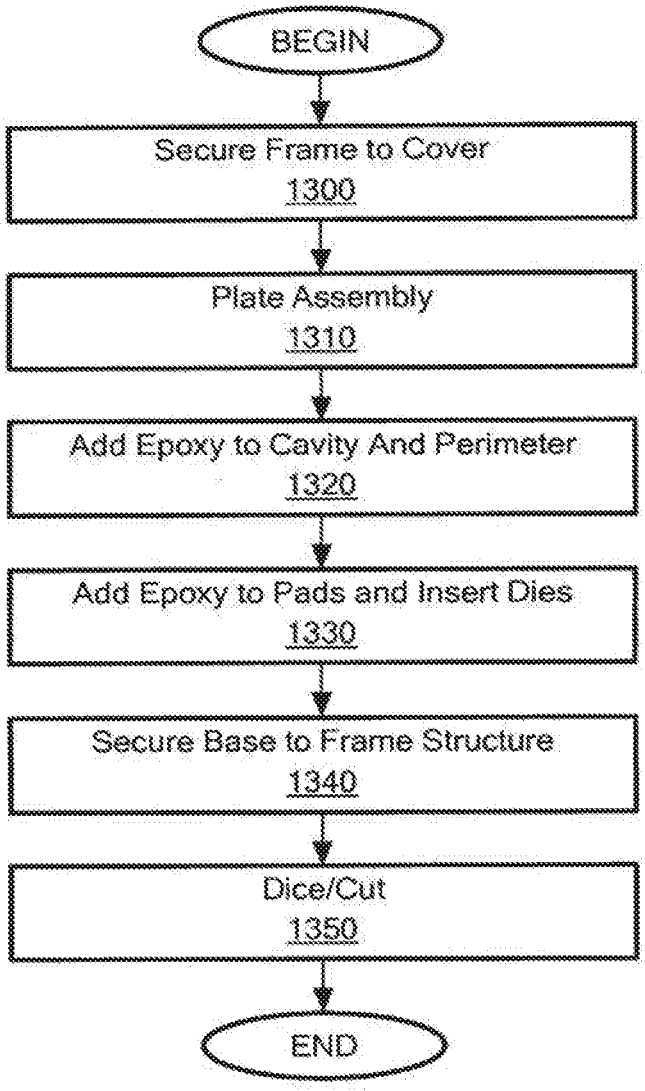
FIG. 13 shows a process of forming a packaged microphone in accordance with illustrative embodiments of the invention.

FIG. 13 shows a process of using the panel 74 of FIG. 12 to fabricate a plurality of packaged microphones 10. Although this process is discussed in terms of the packaged microphone 10 of a few of the embodiments discussed above, it can be applied to other embodiments, such as others not explicitly discussed. It should be noted that this process is a simplified version of an actual fabrication process they can have many more steps. For example, this process may have a testing step, or additional steps for performing one of the noted steps. In addition, many of the steps of the process can be performed in a different order than that disclosed. For example, steps 1320 and 1330 can be performed in a different order. In fact, some steps can be performed at substantially the same time. Accordingly, this process is but one of many different illustrative processes that may implement various embodiments the invention.

Moreover, although batch processing is discussed, some embodiments may be implemented to fabricate the packaged microphone 10 in non-batch, single device processing steps. Accordingly, discussion of batch processes is illustrative and not intended to limit various embodiments.

The process begins at step 1300, which secures the frame 50 to the cover 52 to form the lid structure 16. As noted above, this can involve any of a number of connection processes, such as welding and/or conventional adhesive processes. Next, step 1310 plates the assembly to provide an electromagnetic interference shield, which mitigates the impact of electromagnetic interference on the overall packaged microphone 10. To that end, this step may perform a conventional plating operation, such as an electroless copper-nickel process. This may immerse the lid structure 16 in an electroless bath and thus, effectively complete formation of the panel 74 shown in FIG. 12.

The process then adds die attach epoxy to prescribed regions of the panel 74 for subsequent connection with the microphone dies 24, circuit dies 26, and bases 14 (step 1320). Specifically, the process may deposit die attach epoxy within each concavity 54 for subsequently securing the microphone die 24 and the circuit die 26. In addition, the same die attach epoxy may be applied around the perimeter of each frame structure 50 to secure the bases 14.

Before, at the same time as, or after completing step 1320, the process may add conductive epoxy to the pads 28A and 28B of the microphone die 24 and the circuit die 26 (step 1330). Alternatively or in addition, the step may apply a bump or solder ball 60 to the die pads 48A and 48B. This step also inserts or secures the dies 24 and 26 to the appropriate recesses or concavities 54 within the frame structure 50. Physical placement of the dies 24 and 26 within the concavities 54 causes the die attach epoxy to ooze upwardly and substantially surround the outer periphery of the microphone dies 24. Accordingly, this epoxy effectively forms the above noted seal 62, which divides the interior chamber 18 into the noted front volume and back volume Next, step 1340 places base material over the entire lid structure 16 to form the interior chamber 18. Specifically, the adhesive around the peripheries of each frame structure 50 secures a corresponding panel or sheet of base material with the frame structures 50. Pin connection structures 76 at the four corners of the overall panel 74 can ensure that the two panels are precisely aligned. Among other things, this ensures that the pads 48A and 48B on the appropriate dies 24 and 26 contact corresponding pads on the interior surface of the base 14.

The process concludes by dicing/cutting the overall panel structure in two dimensions, consequently forming a plurality of individual packaged microphones 10 (step 1350).

Accordingly, the frame structure 50 avoids the need for costly flip chipping equipment and enables batch processing. Moreover, various embodiments provide the flexibility to mount the microphone die 24 in a manner that protects the diaphragm 36 from high-pressure events.

Although the above discussion discloses various exemplary embodiments of the invention, it should be apparent that those skilled in the art can make various modifications that will achieve some of the advantages of the invention without departing from the true scope of the invention.

What is claimed is:

1. A method of forming a packaged microphone, the method comprising:

securing an array of covers to an array of molded frames to form an array of assemblies, each frame having a surface forming a concavity;

mounting a plurality of microphone dies within a plurality of the concavities in the array of molded frames, each of the plurality of concavities having no more than one microphone die, the plurality of concavities supporting the plurality of microphone dies;

securing an array of substrates to the array of assemblies to form an array of packages that each have an interior chamber, each of the array of packages having a seal that divides the interior chamber into a back volume and a front volume within the interior chamber, the plurality of microphone dies mounted within the plurality of concavities in a manner permitting ease of electrical interconnection with an underlying package base; and forming an aperture in the substrate or a lid structure of a corresponding microphone die in each of the plurality of microphone dies, the aperture permitting the acoustic signal to directly contacting the microphone die within the interior chamber; and dicing the array of packages to form individual packages.

2. The method as defined by claim 1 wherein securing an array of covers comprises welding the array of covers to the array of frames.

3. The method as defined by claim 1 further comprising forming metal on the surface of the array of assemblies to provide protection from electromagnetic interference.

4. The method as defined by claim 1 wherein each of the plurality of microphone dies has an interface pad, the method further comprising forming at least one of bump and a solder ball on each of the interface pads before securing the array of substrates.

5. The method as defined by claim 1 further comprising adding a seal adhesive around each of the plurality of microphone dies before securing the array of substrates.

6. The method as defined by claim 1 wherein each cover comprises a printed circuit board, further wherein the array of substrates comprises a printed circuit board material.

7. The method as defined by claim 1 further comprising forming a variable capacitor from a diaphragm and a backplate of a microphone die of a diced package prior to the dicing step and mounting the microphone die of the diced package with the diaphragm positioned between an aperture through the diced package and the backplate, the diaphragm positioned a first distance from the aperture and the backplate positioned a second distance from the aperture.

8. The method as defined by claim 1 further comprising electrically connecting the microphone die of the diced package to a substrate of the diced package using a bump or ball.

9. The method as defined by claim 1 wherein the seal is an O-ring.

10. The method as defined by claim 1 further comprising forming each lid structure from a corresponding molded frame and cover.

11. The method as defined by claim 1 further comprising forming a diaphragm a distance away from the aperture of each of the plurality of microphone die.

12. The method as defined by claim 11 comprising including forming each front volume, at least in part, by a corresponding aperture and a portion of a corresponding diaphragm facing the corresponding aperture and forming each back volume, at least in part, from rest of a corresponding interior chamber.

13. The method as defined by claim 12 wherein forming the backplate from single crystal silicon.

14. The method as defined by claim 12 wherein forming the diaphragm and backplate from different material.

15. The method as defined by claim 11 further comprising forming a backplate, in each microphone die, a second distance from a corresponding aperture positioned on an opposite side of the corresponding aperture relative to a position of a corresponding backplate relative to the corresponding aperture.

16. The method as defined by claim 11 wherein forming the diaphragm includes depositing polysilicon.

17. The method as defined by claim 1 wherein each concavity receives a corresponding microphone die forming a toroidal region with a central portion extending into a backside cavity of the corresponding microphone die.

18. The method as defined by claim 17 wherein the central portion includes an opening connecting the corresponding microphone die with a package back volume.

* * * * *